US008626008B2

(12) United States Patent
Kikuchi et al.

(10) Patent No.: US 8,626,008 B2
(45) **Date of Patent: *Jan. 7, 2014**

(54) ELECTROPHOTOGRAPHIC IMAGE FORMING APPARATUS WITH REMOVED DEVELOPER ACCOMMODATING CONTAINER FOR RECEIVING DEVELOPER CLEANED FROM AN IMAGE BEARING MEMBER

(71) Applicant: Canon Kabushiki Kaisha, Tokyo (JP)

(72) Inventors: Ken Kikuchi, Mishima (JP); Tsutomu Nishiuwatoko, Numazu (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/754,080

(22) Filed: Jan. 30, 2013

(65) Prior Publication Data

US 2013/0209138 A1 Aug. 15, 2013

Related U.S. Application Data

(62) Division of application No. 12/768,161, filed on Apr. 27, 2010, now Pat. No. 8,396,380.

(30) Foreign Application Priority Data

Dec. 14, 2009 (JP) ..... 2009-282693

(51) Int. Cl.
*G03G 21/12* (2006.01)

(52) U.S. Cl.
USPC ..... 399/35

(58) Field of Classification Search
USPC ..... 399/35, 111, 123, 120, 358, 360
See application file for complete search history.

(56) References Cited

U.S. PATENT DOCUMENTS

| | | | |
|---|---|---|---|
| 5,585,902 | A | 12/1996 | Nishiuwatoko et al. |
| 5,708,952 | A | 1/1998 | Taniguchi et al. |
| 5,729,796 | A | 3/1998 | Miura et al. |
| 5,815,644 | A | 9/1998 | Nishiuwatoko et al. |
| 5,893,006 | A | 4/1999 | Kanno et al. |
| 5,937,240 | A | 8/1999 | Kanno et al. |
| 5,943,528 | A | 8/1999 | Akutsu et al. |
| 6,009,288 | A | 12/1999 | Akutsu |
| 6,070,029 | A | 5/2000 | Nishiuwatoko et al. |
| 6,078,764 | A | 6/2000 | Akutsu |
| 6,115,569 | A | 9/2000 | Akutsu |
| 6,137,971 | A | 10/2000 | Sasaki et al. |
| 6,137,973 | A | 10/2000 | Nishiuwatoko et al. |
| 6,141,508 | A | 10/2000 | Sasaki et al. |
| 6,704,522 | B2 | 3/2004 | Sasago et al. |
| 6,714,746 | B2 | 3/2004 | Morioka et al. |
| 6,819,885 | B2 | 11/2004 | Serizawa |

(Continued)

FOREIGN PATENT DOCUMENTS

JP 2002-82505 3/2002

*Primary Examiner* — G. M. Hyder
(74) *Attorney, Agent, or Firm* — Fitzpatrick, Cella, Harper & Scinto

(57) ABSTRACT

An electrophotographic image forming apparatus for forming an image on a recording material includes an image bearing member for bearing a developer image and a cartridge that contains a developer that has a developing roller. A cleaning member is provided for removing developer remaining on the surface of the image bearing member, and a removed-developer accommodating container is provided for accommodating the developer removed by the cleaning member.

4 Claims, 18 Drawing Sheets

(56) References Cited

U.S. PATENT DOCUMENTS

| | | | |
|---|---|---|---|
| 6,832,057 | B2 | 12/2004 | Oguma et al. |
| 6,901,229 | B2 | 5/2005 | Nishiuwatoko et al. |
| 6,937,839 | B2 | 8/2005 | Harumoto et al. |
| 7,079,787 | B2 | 7/2006 | Ogino et al. |
| 7,184,684 | B2 | 2/2007 | Murakami et al. |
| 7,221,880 | B2 | 5/2007 | Jeong et al. |
| 2003/0219264 | A1 | 11/2003 | Serizawa |
| 2003/0219292 | A1 | 11/2003 | Serizawa |
| 2005/0260018 | A1 | 11/2005 | Jang et al. |
| 2008/0181633 | A1 | 7/2008 | Oh |
| 2009/0010694 | A1 | 1/2009 | Jang et al. |
| 2010/0080615 | A1 | 4/2010 | Kikuchi |

ELECTROPHOTOGRAPHIC IMAGE FORMING APPARATUS WITH REMOVED DEVELOPER ACCOMMODATING CONTAINER FOR RECEIVING DEVELOPER CLEANED FROM AN IMAGE BEARING MEMBER

This application is a divisional of U.S. patent application Ser. No. 12/768,161, filed Apr. 27, 2010.

FIELD OF THE INVENTION AND RELATED ART

The present invention relates to an electrophotographic image forming apparatus for forming an image on a recording material, wherein cartridge is dismountably mounted to a main assembly of the apparatus.

Here, the electrophotographic image forming apparatus forms an image on the recording material using an electrophotographic image forming process. The examples of the electrophotographic image forming apparatus include an electrophotographic copying machine, an electrophotographic printer (a laser beam printer, an LED printer, for example), a facsimile device, and a word processor. On a recording material, an image is formed by the electrophotographic image forming apparatus and it includes paper, for example, an OHT sheet, and so on.

The cartridge is a process cartridge, a developing cartridge or the like and contributes to an image forming process for forming the image on the recording material in the state that it is mounted to the main assembly of the electrophotographic image forming apparatus. Here, the process cartridge contains at least one of the charging means, developing means, cleaning means as process means, and the electrophotographic photosensitive drum as a unit integrally, and it is dismountably mountable to the main assembly. The process cartridge may contain the developing means as the process means and the electrophotographic photosensitive drum as a unit, and it is dismountably mounted to the main assembly of the electrophotographic image forming apparatus. The process cartridge may contain the charging means, the developing means, or the cleaning means as the process means and the electrophotographic photosensitive drum as a unit, and it is dismountably mounted to the main assembly. A process cartridge which is provided integrally with the electrophotographic photosensitive drum and the developing means is a so-called integral type. The process cartridge which is provided integrally with the electrophotographic photosensitive drum and the process means other than the developing means is called a discrete type process cartridge. In this case, the developing means is provided in a developing unit unintegral with the process cartridge, and the discrete type process cartridge forms the image using the combination with such a developing unit. The process cartridge can be mounted and demounted relative to the apparatus main assembly by the user. For this reason, the maintenance of the apparatus is easy. The act of the process means is carried out on the electrophotographic photosensitive drum.

The developing cartridge includes the developing roller, contains the powdery developer (toner) for developing the electrostatic latent image formed on the photosensitive drum by the developing roller, and is dismountably mounted to the apparatus main assembly. In the case of the developing cartridge, the electrophotographic photosensitive drum is mounted to a main assembly or a cartridge supporting member. Or, the electrophotographic photosensitive drum is provided in a so-called discrete type process cartridge In this case, the process cartridge is not provided with the developing means. The developing cartridge can also be mounted and demounted relative to said main assembly by the user. For this reason, the maintenance of the apparatus is easy.

Therefore, the cartridge in this invention includes the process cartridges of a so-called the integral type or a so-called discrete type. The cartridge includes a combination of the so-called process cartridge of the discrete type and the developing cartridge. In another example of the cartridge, the electrophotographic photosensitive drum is mounted fixedly to the main assembly or the cartridge supporting member, and the detachably mountable developing cartridge acts on the electrophotographic photosensitive drum.

As has been described hereinbefore heretofore the electrophotographic image forming apparatus which forms the image on the recording material using the electrophotographic image forming process is known. In this electrophotographic image forming apparatus, the process cartridge type described above is known. In addition, the developing cartridge type which comprises only the developing unit unintegral with the photosensitive drum is known. In the present invention, the process cartridge type and the developing cartridge type are usable. The process cartridge and the developing cartridge are provided with a developer accommodating portion which contains the developer (toner) for developing the electrostatic latent image.

In the electrophotographic image forming apparatus of a type which uses a plurality of cartridges, the structure is known in which the developer removed from a photosensitive drum surface is stored in a common waste toner collecting container (Japanese Laid-open Patent Application 2002-82505).

SUMMARY OF THE INVENTION

In the image forming apparatus described above, the developer removed from the photosensitive drum is fed into the waste toner collecting container disposed in a lower part of the cartridges by a pipe.

An object of the present invention is to provide an electrophotographic image forming apparatus in which a removed developer accommodating container is disposed efficiently.

Another object of the present invention is to provide an electrophotographic image forming apparatus in which the developer removed from a plurality of photosensitive drums can be stored in the common removed developer accommodating container.

A further object of the present invention is to provide an electrophotographic image forming apparatus in which a plurality of cartridges are mounted adjacent to each other and which is downsized.

According to the present invention, a removed developer accommodating container is disposed efficiently.

According to the present invention, the developer removed from a plurality of photosensitive drums can be stored in the common removed developer accommodating container.

According to the present invention, a plurality of cartridges are mounted adjacent to each other and which is downsized.

These and other objects, features, and advantages of the present invention will become more apparent upon consideration of the following description of the preferred embodiments of the present invention, taken in conjunction with the accompanying drawings.

Figure 3:
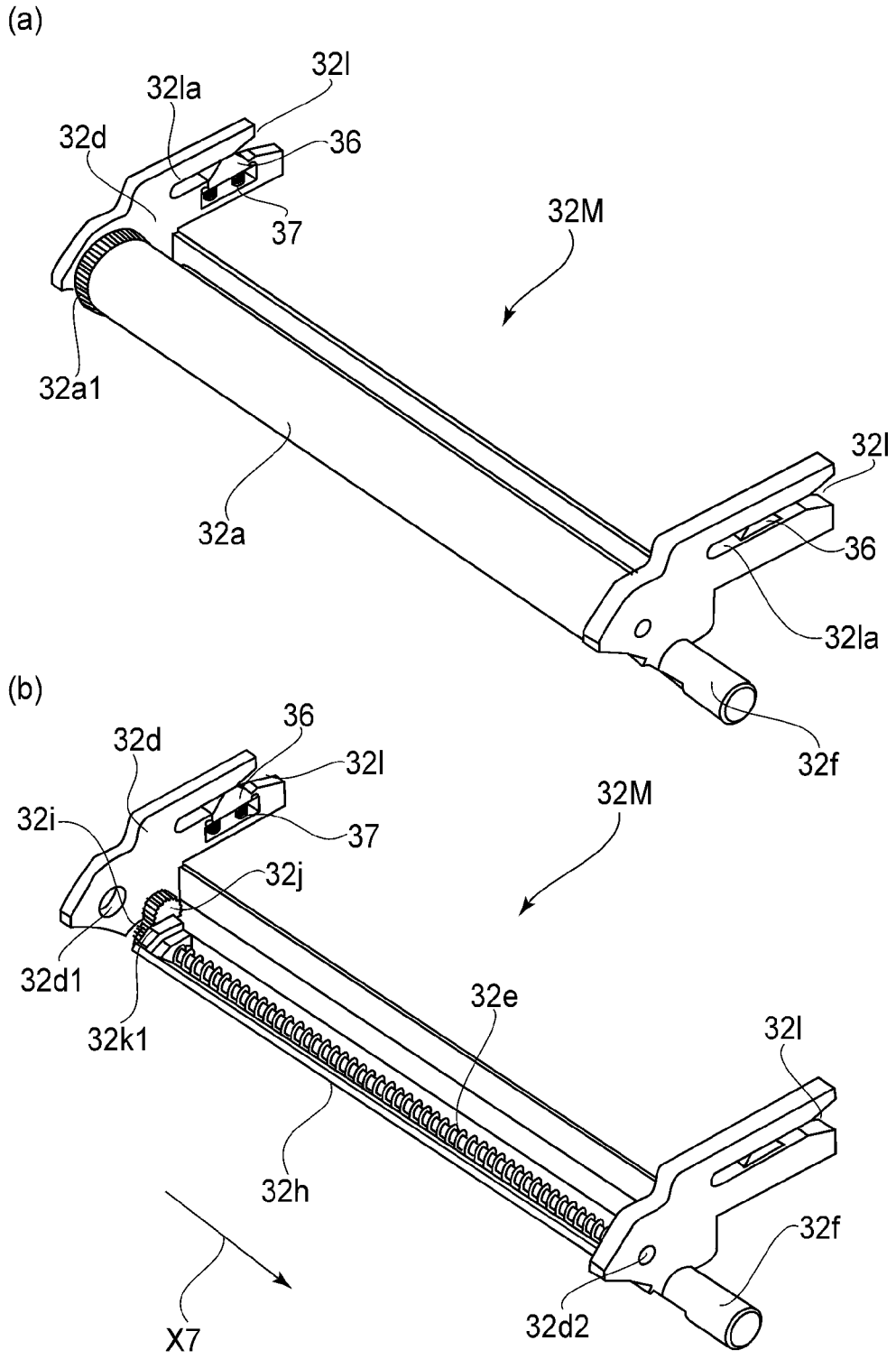

Part (a) of FIG. 3 is a left-hand side perspective view of one photosensitive member unit, and (b) is a perspective view of the photosensitive member unit (photosensitive member case) from which a drum, a charging roller, and a cleaning blade are dismounted.

Figure 4:
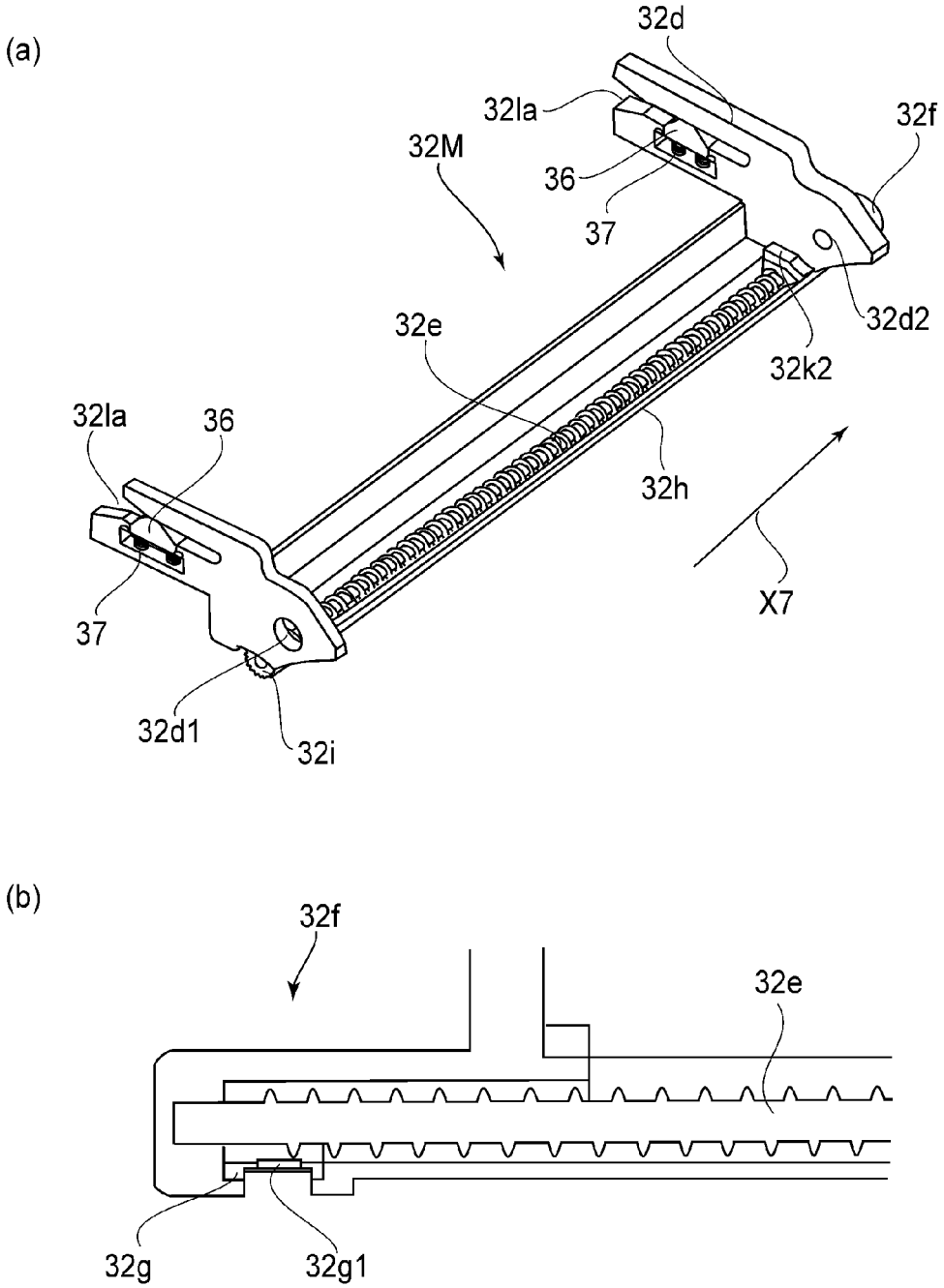

A part (a) of FIG. 4 is a right-hand side perspective view of a photosensitive member case of (b) of FIG. 3, and (b) is an enlarged vertical longitudinal sectional view of a removed developer discharging portion of the photosensitive member case.

Figure 5:
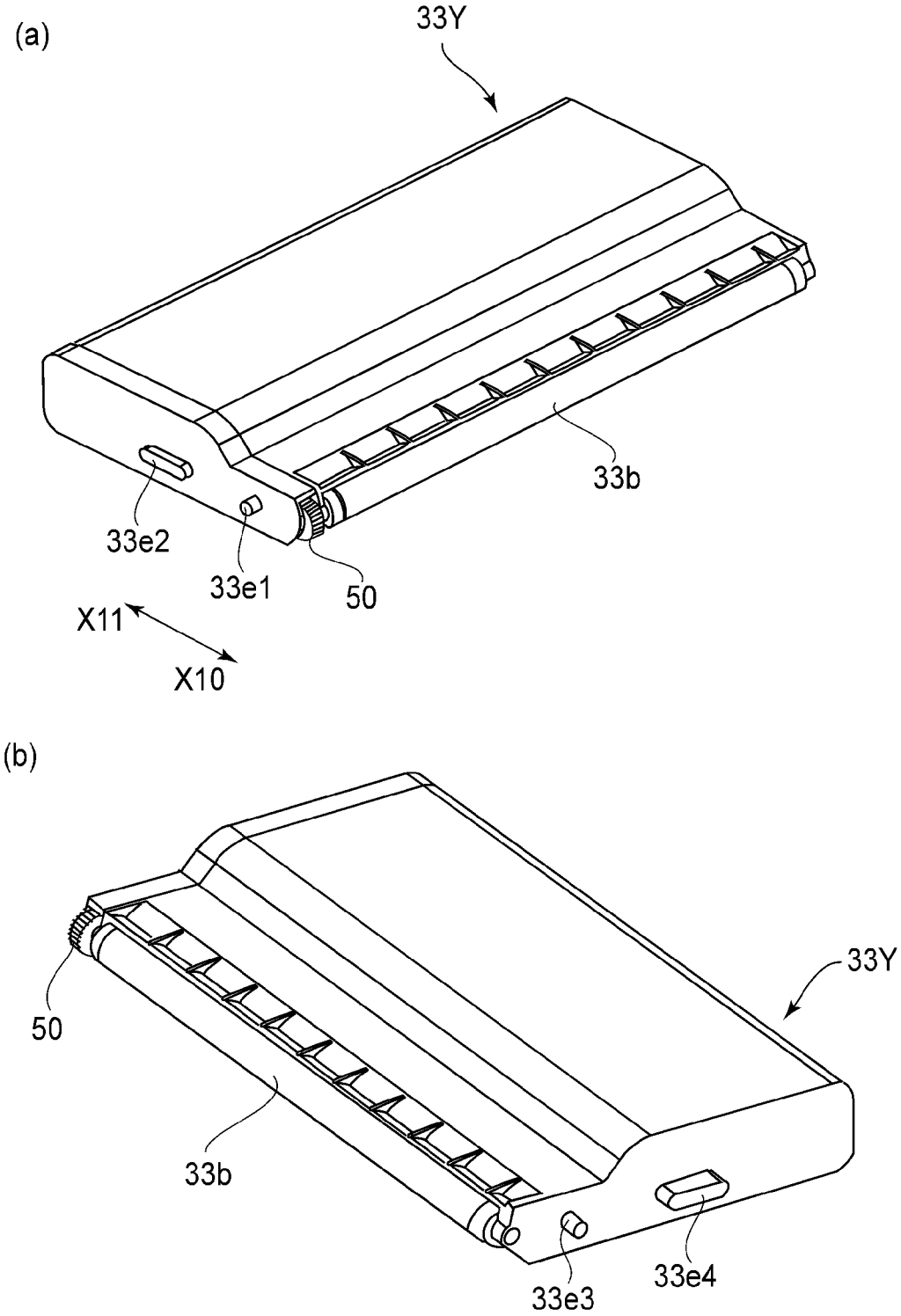

Part (a) of FIG. 5 is a right-hand side perspective view of a cartridge, and (b) is a left-hand side perspective view thereof.

Figure 6A:
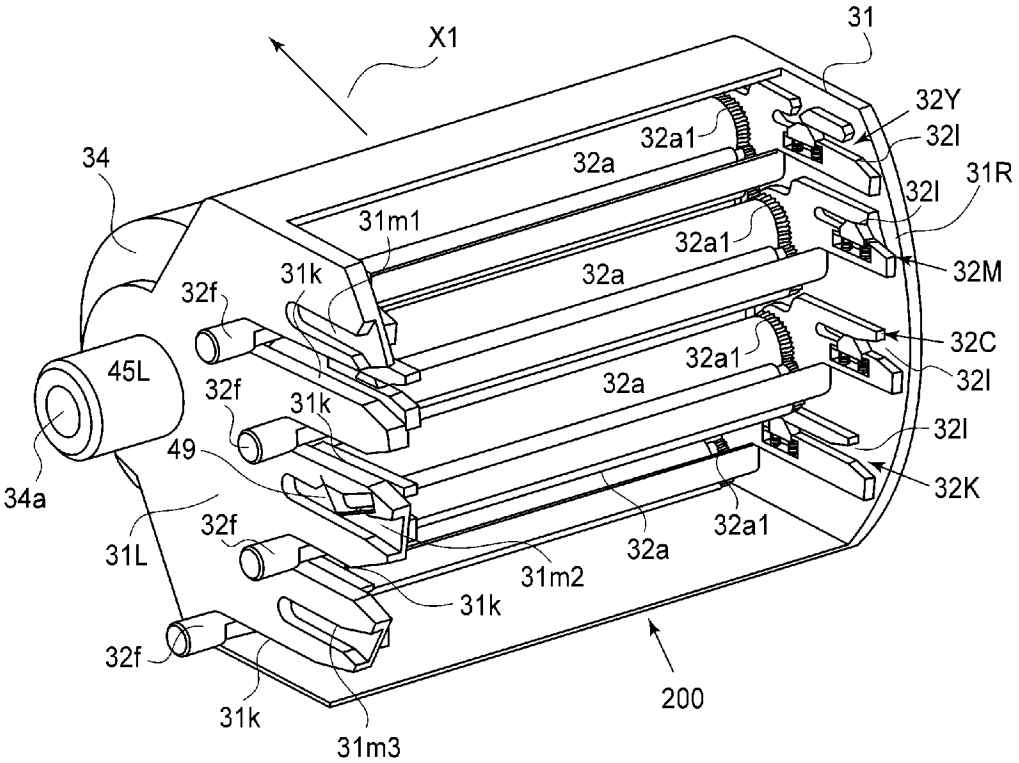

FIG. 6A is a left-hand side perspective view of an image forming unit.

Figure 6B:
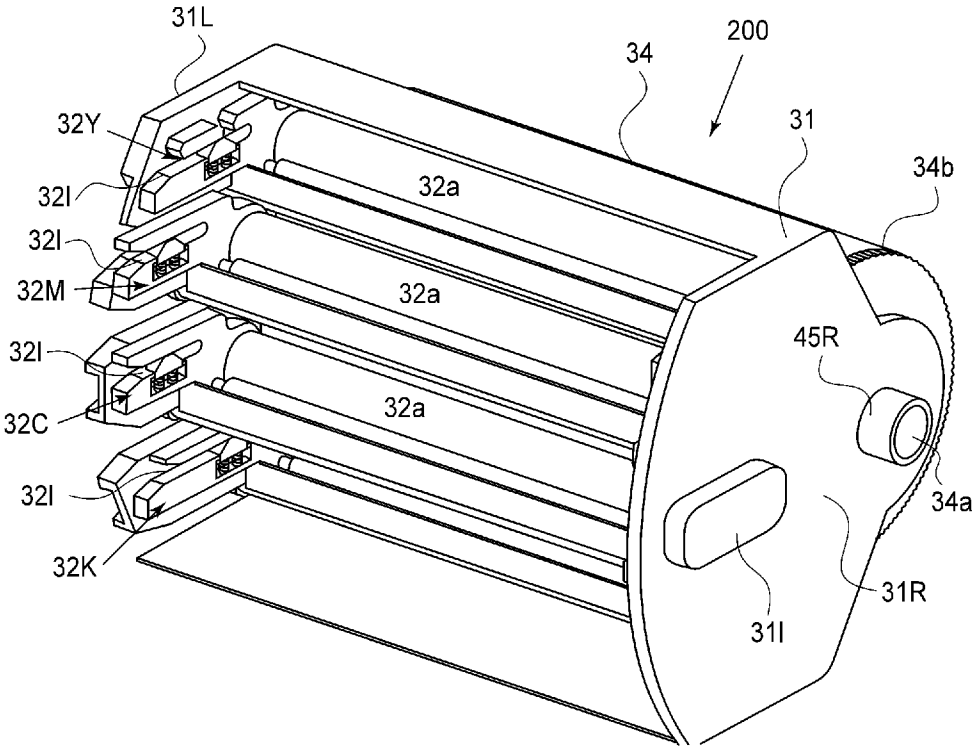

FIG. 6B is a right-hand side perspective view thereof.

Figure 7:
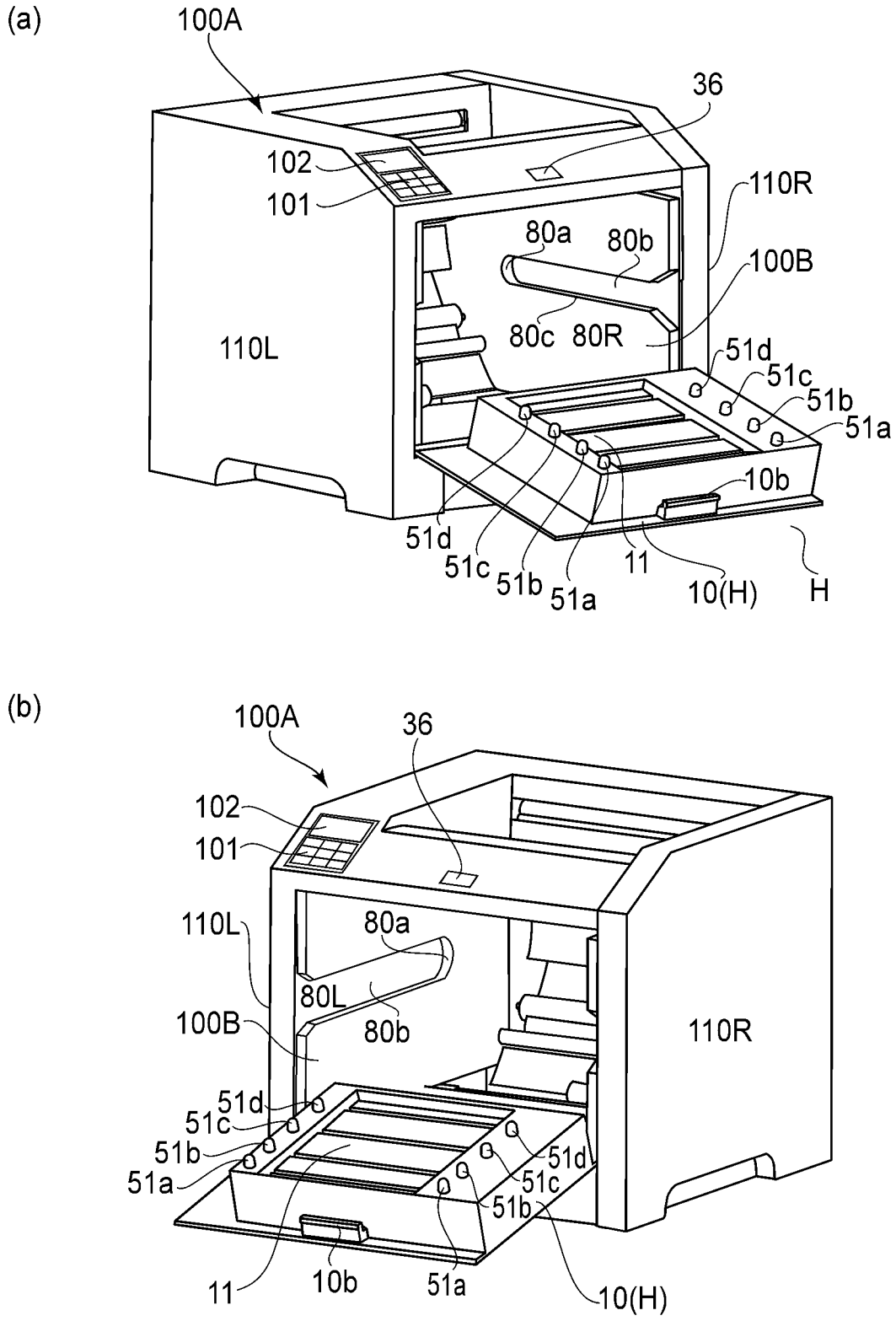

Part (a) of FIG. 7 is a left-hand side perspective view of a main assembly in the state that a maintenance cover is open, and (b) is a right-hand side perspective view thereof.

Figure 8:
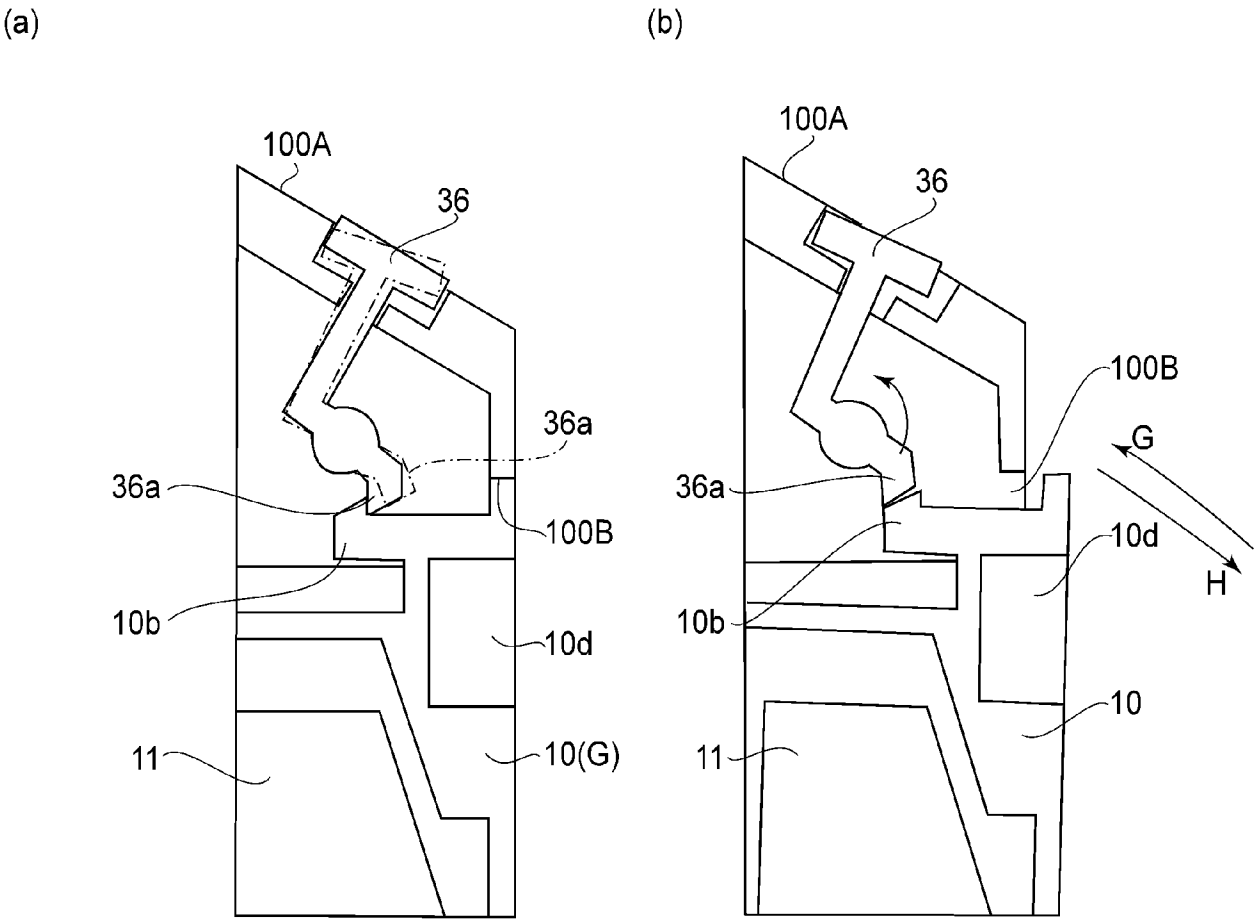

FIG. 8 is an illustration of a maintenance button.

Figure 9A:
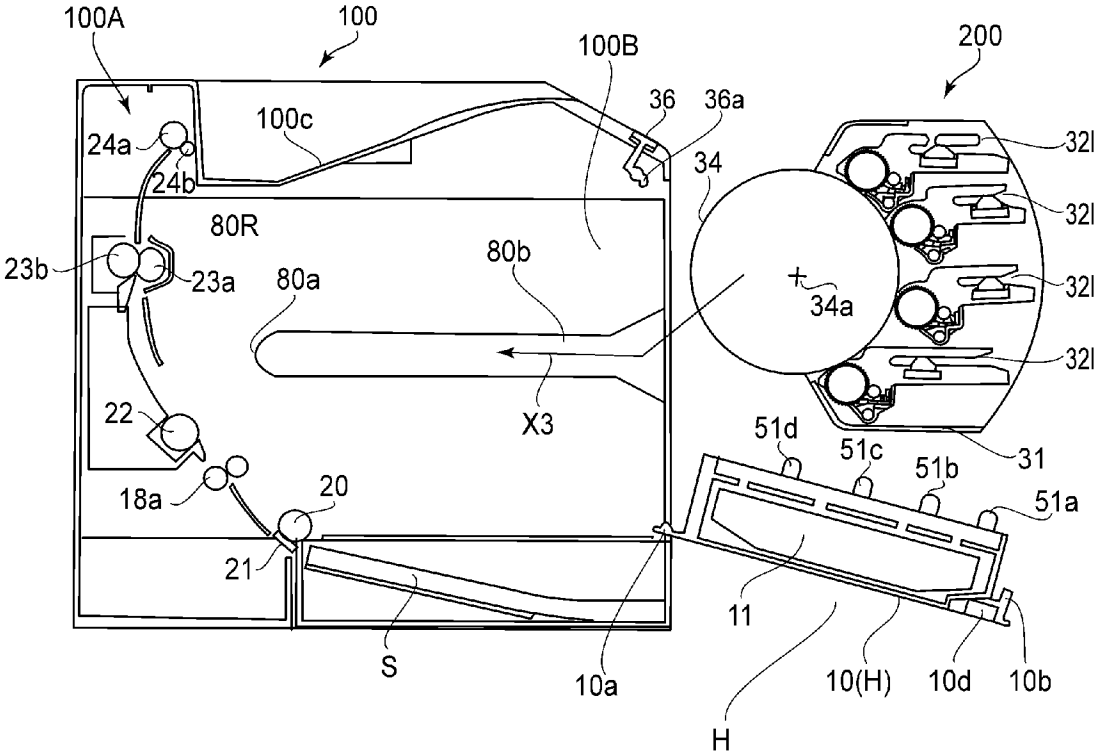
Figure 9B:
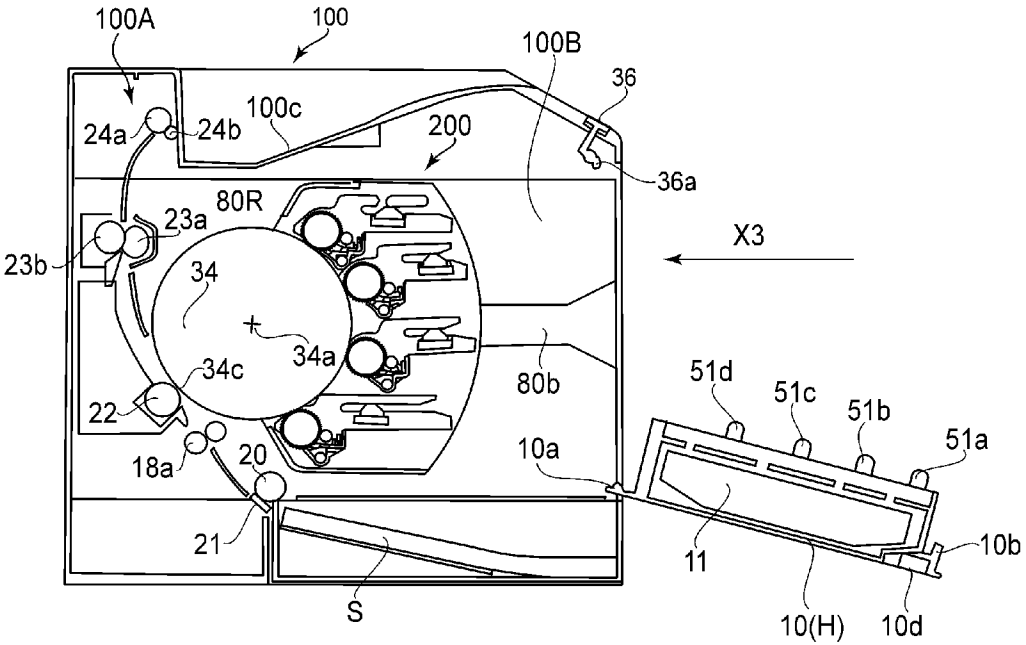

FIGS. 9A and 9B are illustrations of the mounting process of the image forming unit relative to the main assembly.

Figure 10:
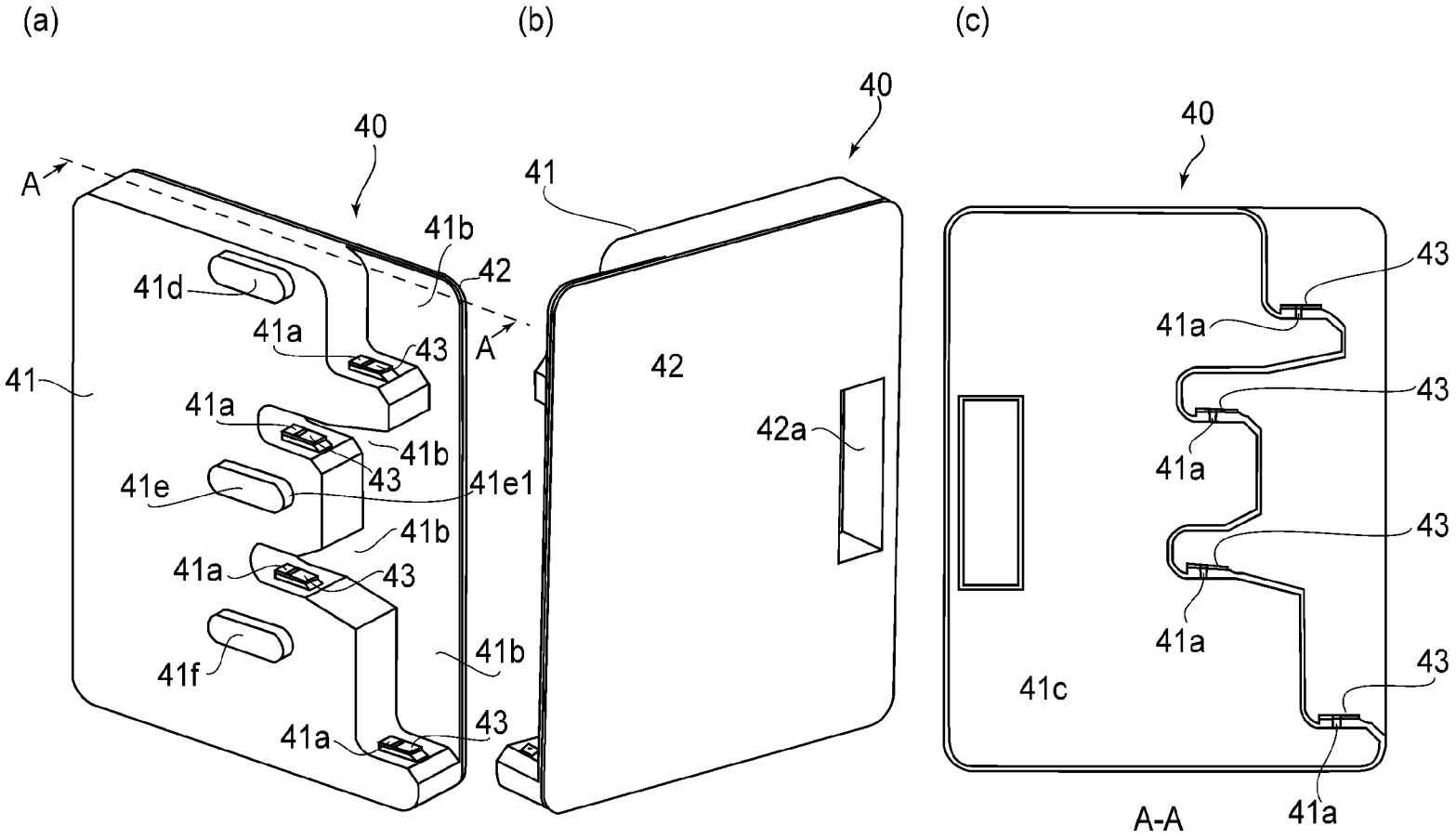

A part (a) of FIG. 10 is a right-hand side perspective view of a residual developer container, and (b) is a left-hand side perspective view of the residual developer container, and (c) is a sectional view taken along a section line A-A of (a).

Figure 11:
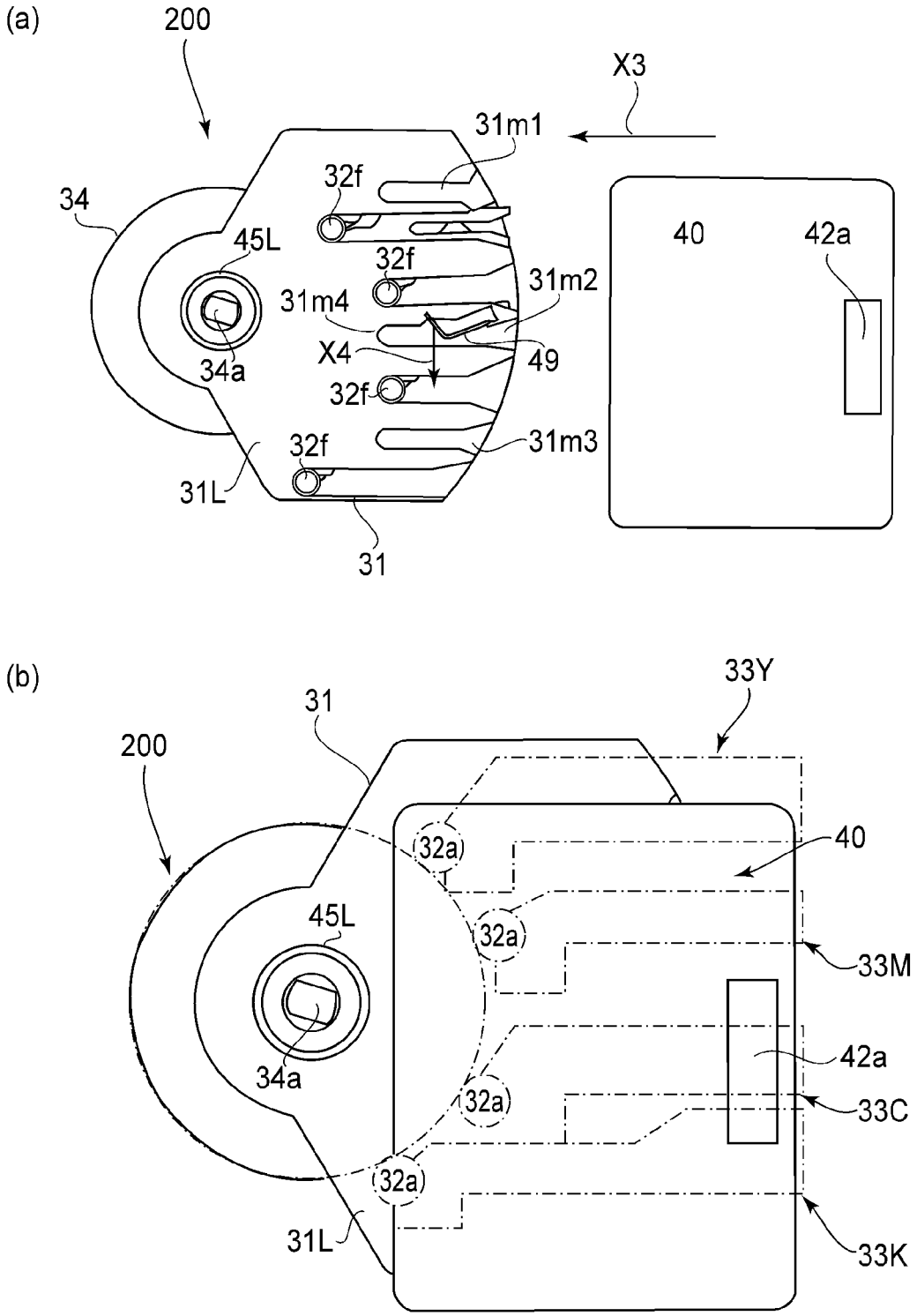

FIG. 11 is an illustration of mounting and demounting processes of the residual developer container relative to the image forming unit.

Figure 12A:
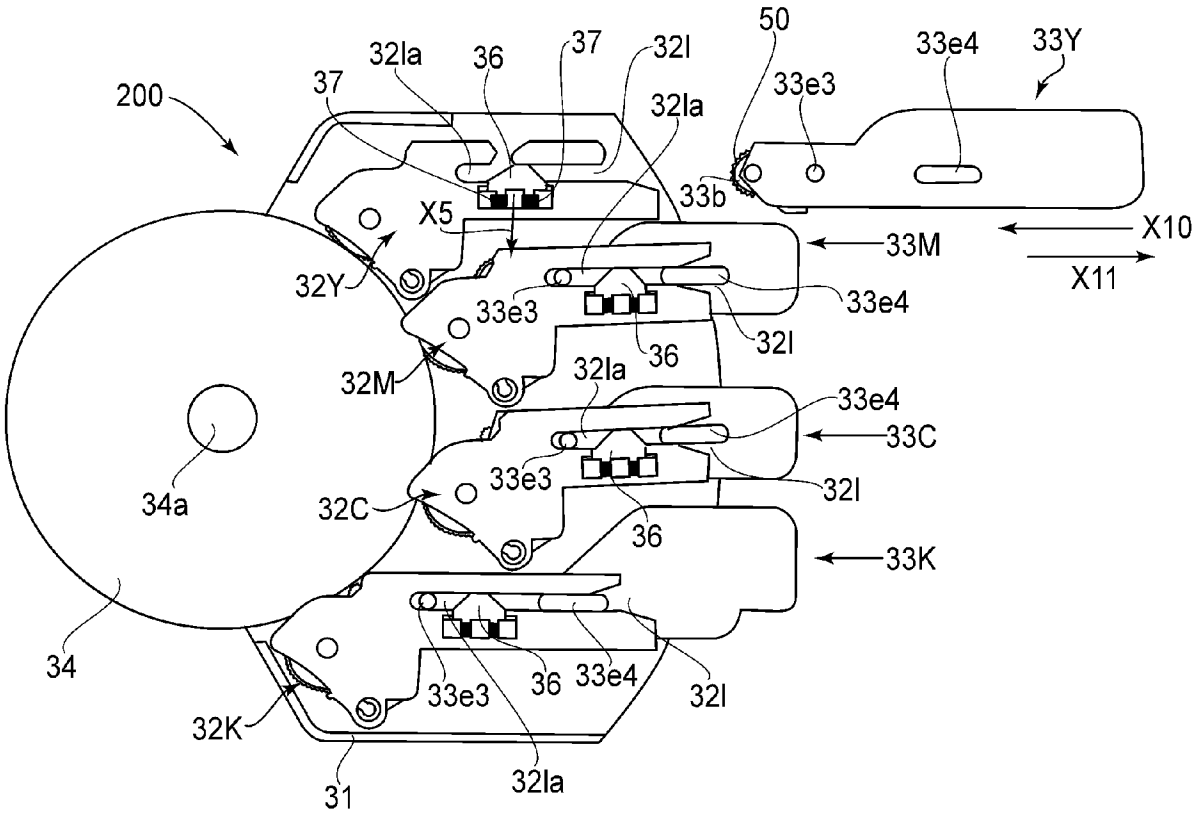
Figure 12B:
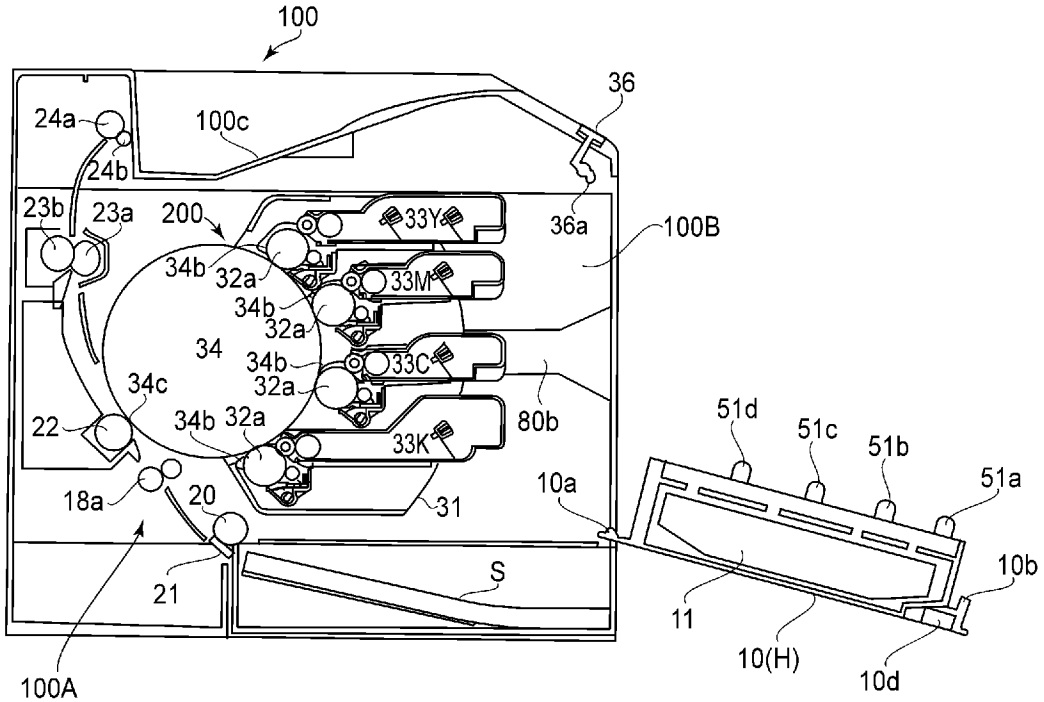

FIGS. 12A and 12B are illustrations of the mounting and demounting processes of the cartridge relative to the unit.

Figure 13:
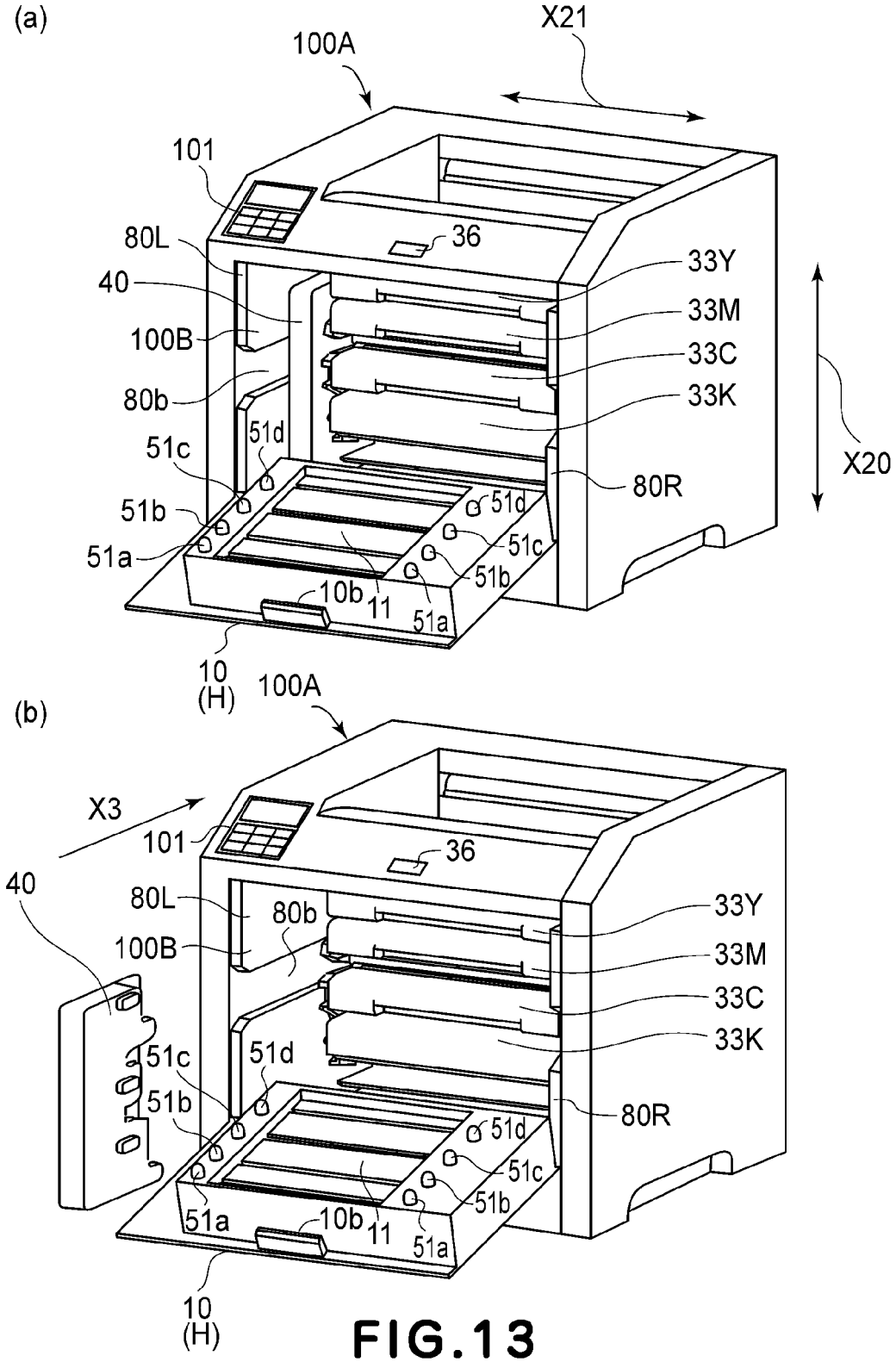

FIG. 13 is an illustration of mounting and demounting processes of the residual developer container relative to the image forming unit.

Figure 14:
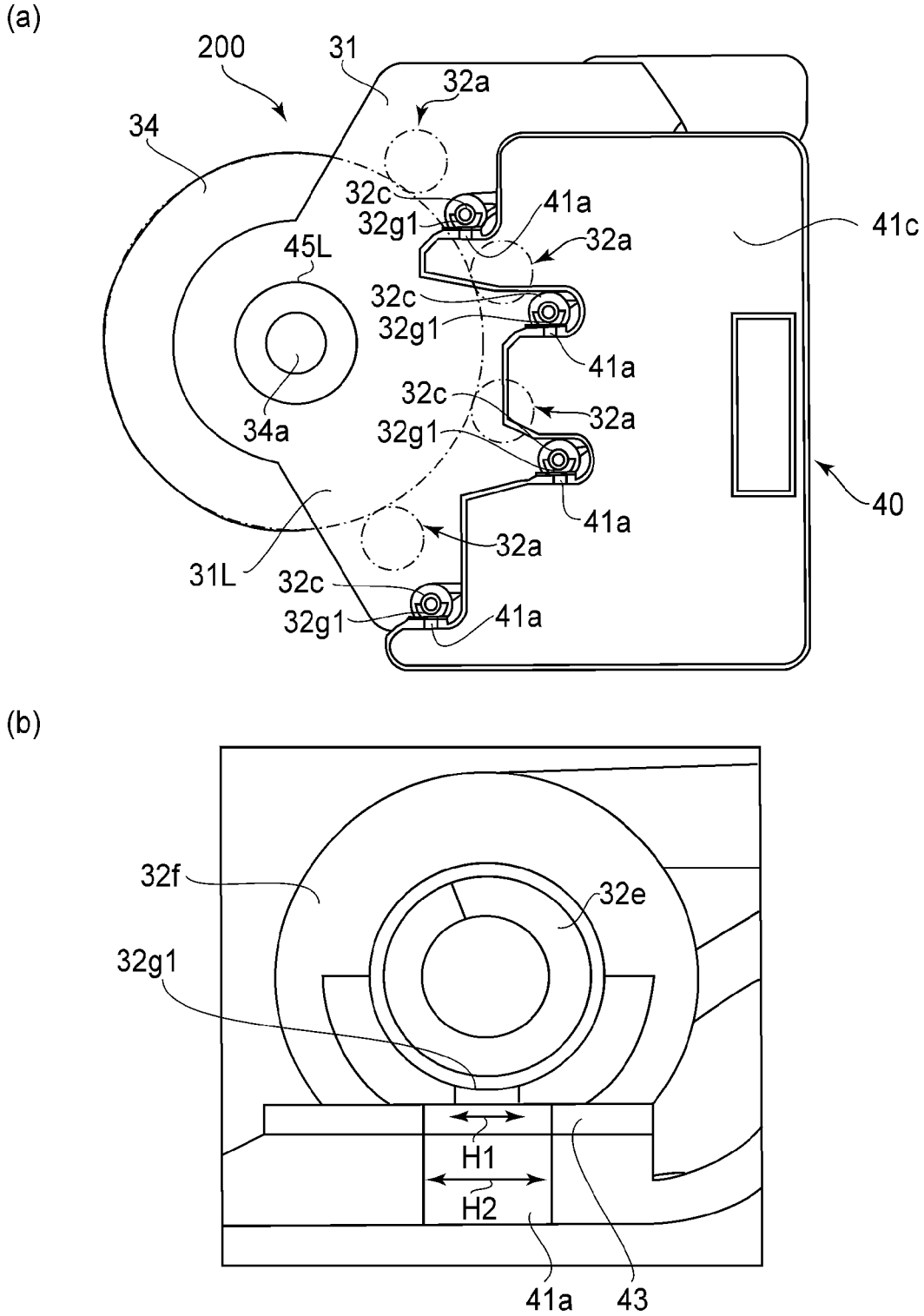

FIG. 14 is an illustration of mounting and demounting processes of the residual developer container relative to the image forming unit.

DESCRIPTION OF THE PREFERRED EMBODIMENTS

The preferred embodiments of the present invention will be described in conjunction with the accompanying drawings. The dimensions, the materials, the configurations, the relative positions, and so on of the constituent parts which will be described hereinafter may be properly changed by one skilled in the art depending on the structures and the various conditions of a device to which this invention is applied, and the scope of this invention is not limited to specific dimensions, materials, configurations, relative positions and so on of the embodiments which will be described below.

Embodiment 1

(Overall General Arrangement of Example of the Electrophotographic Image Forming Apparatus)

Figure 1A:
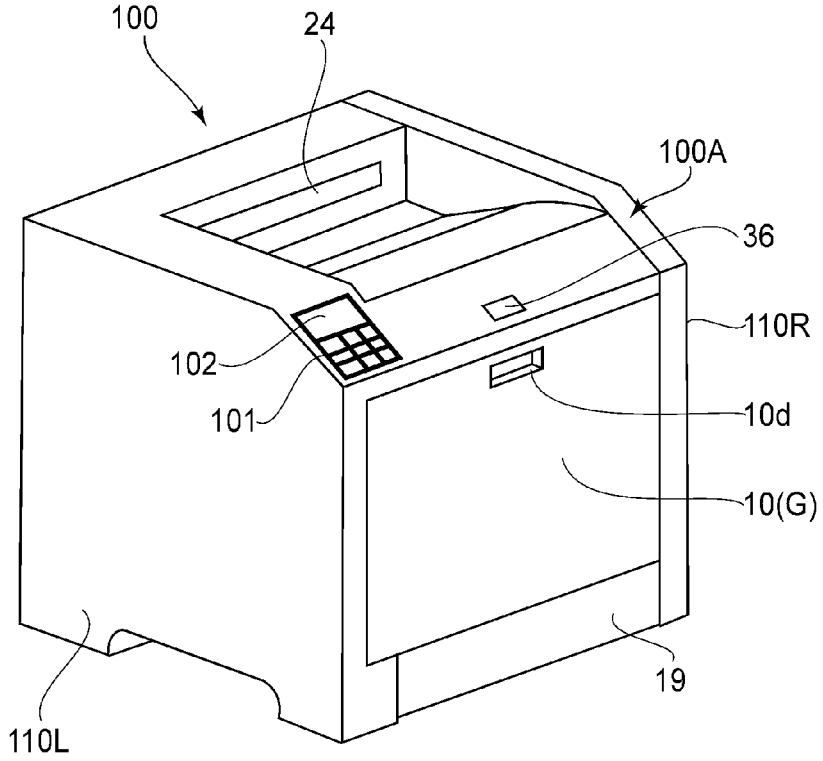
FIG. 1A is an outer appearance perspective view of an image forming apparatus according to Embodiment 1.

FIG. 1A is an outer appearance perspective view of an electrophotographic image forming apparatus (image forming apparatus, or simply apparatus) 100 in this embodiment. Part (b) is a vertical section left side view of an image forming apparatus 100. The image forming apparatus 100 is a laser printer of a full-color (four colors) type which uses the electrophotographic process. The image forming apparatus 100 forms a full-color image on a recording material (sheet) S on the basis of the electrical image signal inputted to a control circuit portion 300 from an external host device 400 such as a personal computer, an image reader, a receiving part of a facsimile device.

In the following descriptions, relating to the apparatus 100, the front side is a side in which a feeding cassette 19 which stacks the recording materials S is drawn from an inside of a main assembly 100A to an outside. A backside is the opposite side from it. The upper side is a side in which Recording material S is discharged. The front-rear directions are directions to the front side from the backside of the image forming apparatus and the reverse direction. The left and right are the left and the right of the image forming apparatus, as seen from the front side. The left-right directions are directions to the left from the right, and the reverse direction. The longitudinal direction is an axial direction of an electrophotographic photosensitive drum or a developing roller. The main assembly 100A is a portion of the image forming apparatus except the cartridges 33 33Y, (33M, 33C, 33K) and a removed developer accommodating container 40. In the image forming apparatus of this embodiment, right-hand side is the driving side and left-hand side is the non-driving side.

The image forming apparatus 100 is placed on a substantially horizontal installation surface F such as a mounting base, the desk or the floor. A central portion in the main assembly 100A is provided with the image forming unit 200. FIG. 2 is an enlarged view of the image forming unit 200 shown in FIG. 1B. A unit 200 is provided with a cartridge mounting portions 321 for dismountably mounting a plurality of cartridges 33 (mounting guide) (FIG. 3, FIGS. 6A and 6B) and a single cylindrical intermediary transfer member (transfer member) 34. In this embodiment, a plurality of cartridges 33 are the first-fourth developing cartridge s 33Y, 33M, 33C, 33K.

In this embodiment, each electrophotographic photosensitive drum 32*a* is mounted to the unit 200 as photosensitive member units 32 (32Y, 32M, 32C, 32K) with a charging roller 32*b* and a cleaning blade 32*c*. The charging roller 32*b* and the blade 32*c* are process means. In the apparatus 100, the cartridges 33 are dismountably mounted to the main assembly 100A (unit 200), and a color image is formed on the recording material S. The unit 200 will be described in detail hereinafter.

In this embodiment, the cartridges 33 have the similar structures except that the colors of the contained powdery developers (toner) are different. However, they are not limited to this example. For example, a cartridge 33K which accommodates a black developer may be larger in the capacity of a developer accommodating portion than that of the cartridges 33 which accommodate the other color developers. In this embodiment, the cartridge is a developing cartridge, although the present invention is not limited to this. For example, the drum 32*a*, the charging roller 32*b*, and the cleaning blade 32*c* mounted to the unit 200 in this embodiment may be mounted to the developing cartridge 33. The cartridge of such a structure is called a process cartridge rather than a developing cartridge. The process cartridge contains the drum 32*a* and a charging roller 32*b*, a developing roller 33*b*, and a cleaning blade 32*c* as the process means integrally as a cartridge, and it is dismountably mounted as a unit to the main assembly 100A.

(Photosensitive Member Unit)

Each of the unit 32 (32Y, 32M, 32C, 32K) is fixed to a sub-frame 31 of the unit 200. Each unit 32 includes the drum 32*a*. It is provided with the roller 32*b* and the blade 32*c* for removing the developer which remains on a surface of the drum 32*a* as the process means actable on the drum 32*a*. A feeding screw (feeding member) 32*e* for feeding the developer removed by the blade 32*c* in the axial direction of the drum 32*a* is provided. The drum 32*a*, the roller 32*b*, the blade 32*c*, and a screw 32*e* are assembled to a case 32*d* (FIG. 3) with a predetermined arrangement relation.

FIG. 3A is a perspective view of a unit 32M, as seen from left-hand side. Part (b) of FIG. 3 is a perspective view of a photosensitive member case 32*d* excluding the drum 32*a*, the charging roller 32*b*, and the cleaning blade 32*c* from the unit 32M of (a) of FIG. 3. Part (a) of FIG. 4 is a perspective view of the case 32*d* of (b) of FIG. 3, as seen from a right-hand side, and (b) is an enlarged vertical longitudinal sectional view of a removed developer discharging portion 32*f* of the case 32*d*. The other unit 32Y, 32C and 32K has substantially the same structures, and therefore, the description will be made as to the photosensitive member unit 32M. A right-hand end portion and a left-hand end portion of the case 32*d* are provided with the bearing portions 32*d*1 and 32*d* which comprise through-holes, respectively, which support the drum 32*a* rotatably. The insides of the bearing portions 32*d*1 and 32*d*2 are provided with the end sealing members 32*k*1, 32*k*2 contacting the drum 32*a* and the sheet-like sealing members 32*h* extended in the axial direction of the drum 32*a*. Each of the sealing members 32*k*1, 32*k*2 and 32*h* contacts to the surface of the drum 32*a*, so that the developer in the case 32*d* does not leak to an outside.

An inside of the case 32*d* is provided with a screw 32*e* extended over the length. A right-hand end portion (end) of the screw 32*e* is provided with a feeding gear (drive transmitting portion) 32*i*. The screw 32*e* receives a driving force from a drum gear 32*a*1 mounted to the right-hand end portion of the drum 32*a* through an idler gear 32*j*. A removed developer in the case 32*d* is fed in the direction of the arrow X7 (leftward direction) by rotating operation of the screw 32*e*. The removed developer fed by the screw 32*e* is carried to the removed developer discharging portion 32*f* provided at the left-hand end portion of the screw 32*e*. The discharging portion 32*f* outwardly projects out of the left-hand end portion of the case 32*d*. The removed developer fed by the screw 32*e* is discharged to the outside through an opening 32*g*1 provided in the discharging portion 32*f*. The supply side opening 32*g*1 is provided with a rotatable shutter 32*g*. The shutter 32*g* is moved between an open position for opening the supply side opening 32*g*1 and a closing position for shutting the supply side opening 32*g*1 by the rotation thereof. The shutter 32*g* is moved to the open position by the mounting operation of the residual developer container 40 (FIG. 10, FIG. 11) as will be described hereinafter relative to the unit 200. By this, the removed developer in the case 32*d* can be discharged to the inside of the container 40. When the container 40 is not mounted, the shutter 32*g* is urged to the closing position by an elastic force of a spring (unshown). Therefore, the developer does not leak outside from the container 40.

The right-hand end portion and the left-hand end portion of each unit 32 is each provided with the mounting portion 321 for mounting the cartridge 33, and the mounting portions 321 are extended in the direction perpendicular to the axes of the drums 32*a*, respectively. The mounting portion 321 is provided with the recess (regulating portion) 321*a* for receiving portions-to-be-guided (portions-to-be-regulated) 33*e*1 and 33*e*3 (FIG. 5) of the cartridge 33. Adjacent to a recess 321*a*, there are provided a regulating member 36 for regulating a position of the cartridge 33 and a resilient member (urging member) 37 which elastically urges the regulating member 36.

As has been described hereinbefore, by providing the screw 32*e* for feeding the removed developer to the outside in each unit 32, it is not necessary to provide a space for containing the removed developer in the inside. Therefore, a downsizing of the unit 32 can be accomplished. In this embodiment, the unit 32 is fixed to the unit 200. Therefore, when drum 32*a* or the like is worn, the whole unit 200 is exchanged. However, the unit 32 may be detachably mountable to the unit 200, and in such a case, only the unit 32 is exchanged.

(Cartridge)

As shown in FIG. 2, each of the cartridges 33 (33Y, 33M, 33C, 33K) are provided with a developing roller 33*b* for supplying the developer on the drum 32*a*, more particularly, for developing an electrostatic latent image formed on the drum 32*a* into a developer image with a case 33*a*. The cartridge 33 is provided with the developer accommodating portion 33*c* which accommodates the developer to be used for the development of the electrostatic latent image and a supplying roller 33*d* for supplying the developer in the accommodating portion 33*c* to the roller 33*b*. The developer accommodating portion 33*c* is provided with the feeding member 33*f* for feeding the inner developer to the supplying roller 33*d*. A first cartridge 33Y accommodates the (yellow Y) color developer in the developer accommodating portion 33*c*, and a Y color developer image is formed on the surface of the corresponding drum 32*a*. A second cartridge 33M accommodates the (magenta M) color developer in the developer accommodating portion 33*c*, and a M color developer image is formed on the surface of the corresponding drum 32*a*. A third cartridge 33C accommodates the (cyan C) color developer in the developer accommodating portion 33*c*, and a C color developer image is formed on the surface of the corresponding drum 32*a*. A fourth cartridge 33K accommodates the (black K) color developer in the developer accommodating portion 33*c*, and a K color developer image is formed on the surface of the corresponding drum 32*a*.

Part (a) of FIG. 5 is a perspective view of the cartridge 33Y, as seen from right-hand side, and (b) is a perspective view of that, as seen from left-hand side. The cartridge 33 will be described taking the case of the cartridge 33Y. The cartridge 33Y is mounted in the direction of the arrow X10 to the mounting portion 321 of the unit 200. The cartridge 33Y is dismounted from the mounting portion 321 of the unit 200 by moving it in the direction of an arrow X11 which is opposite to the arrow X10. The cartridge 33Y is provided with the developing roller 33*b* in a leading end with respect to the mounting direction. The right-hand end portion of the roller 33*b* is provided with a gear 50. The gear 50 receives the driving force from the drum gear 32*a*1 (FIG. 3) to rotate the roller 33*b*. The gear 50 transmits the driving force to the roller 33*d* and a feeding member 33*e* through a gear train (unshown).

The right-hand end portion and the left-hand end portion of the cartridge 33Y are provided with the portions-to-be-guided 33*e*1, 33*e*2, 33*e*3 and 33*e*4 for being guided by the unit 200, when the cartridge 33Y is mounted to the unit 200. The portion-to-be-guided 33*e*1 33*e*3 has a cylindrical shape and projects toward the outside of the right-hand end portion and the outside of the left-hand end portion of the cartridge 33Y. The portions-to-be-guided 33*e*2 and 33*e*4 have a substantially rectangular parallelepiped shape, and project toward the outside of the right-end portion and toward the outside of the left-end portion of the cartridge 33Y, and are extended in the direction perpendicular to the longitudinal direction of the cartridge 33. The portions-to-be-guided 33*e*1 and 33*e*3 are placed in a downstream side (with respect to the mounting direction X10 of cartridge 33Y) of the portions-to-be-guided 33*e*2, 33*e*4, respectively. The cartridge 33Y side opposite from the roller (33*b*) side is provided with a grip 39 (FIG. 2)

for griping the cartridge 33Y, the grip 39 being provided by recessing a bottom plate of the case 33*a*. A user can mount and demount the cartridge 33Y relative to the unit 200, while griping the grip 39 and an upper surface portion of the case 33*a*. This applies similarly to the other cartridges 33M, 33C, 33K.

In this embodiment, a transfer member 34 is a cylindrical drum, and the axis of a rotation axis (rotation axis) 34*a* thereof is extended to the horizontal left-right direction, and it is rotatable about the axis thereof. Each cartridge 33 is provided on a front side of the transfer member 34, and extends substantially parallel with the installation surface F of the main assembly 100A. They are provided adjacent to each other with respect to the substantially vertical direction. In the apparatus 100 of this embodiment, the first cartridge 33Y is in the topmost stage, and the second cartridge 33M is placed therebelow. The third cartridge 33C is placed further below. The fourth cartridge 33K takes the bottommost stage position. The roller 33*b* of each cartridge 33 may be in contact to the drum 32*a* (contact type developing system) or, it may be spaced with the predetermined small gap (predetermined distance) from the drum 32*a* (non-contact developing system).

(Scanner Unit)

Figure 1B:
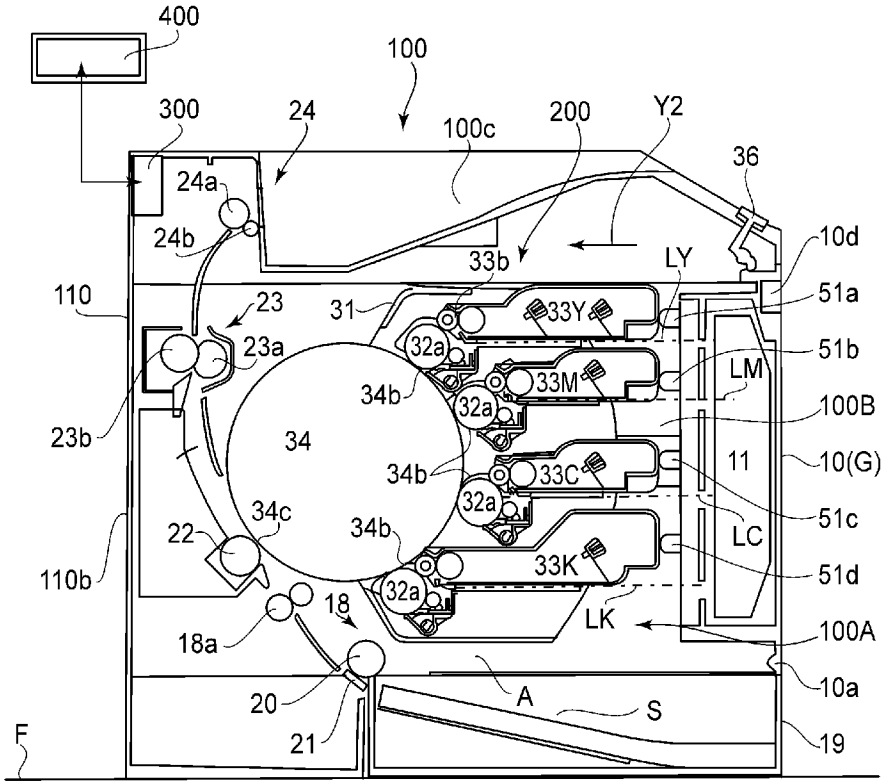
FIG. 1B is a vertical section left side view of the image forming apparatus.
Figure 2:
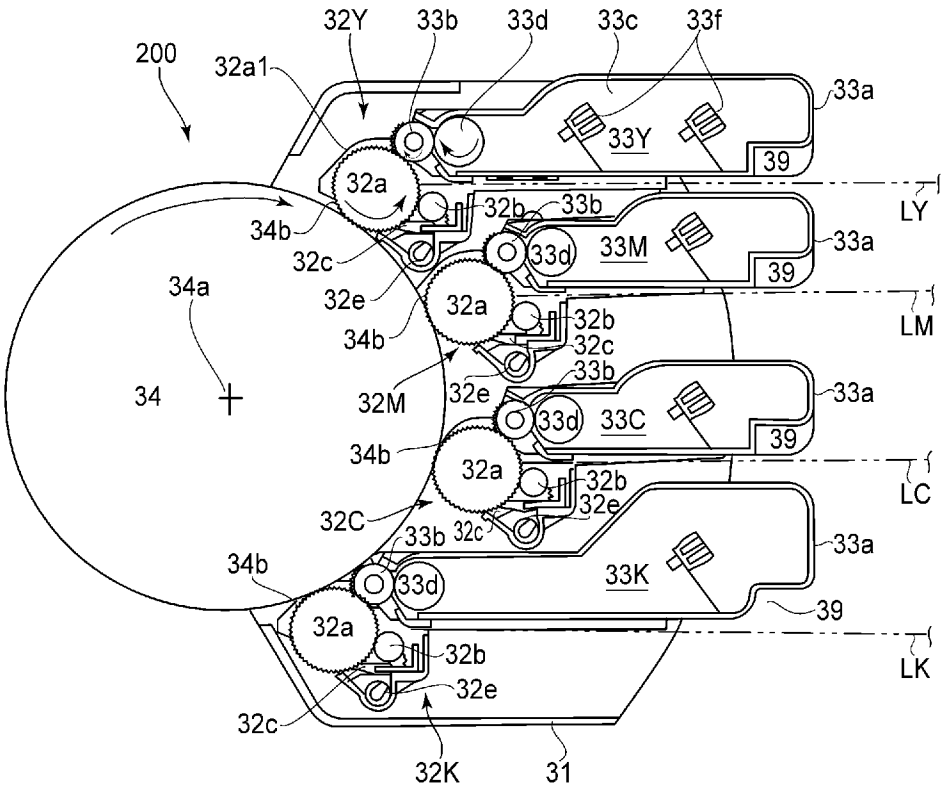
FIG. 2 is an enlarged view of an image forming unit of FIG. 1B.

Referring to FIG. 1A and FIG. 1B, the front part of the front side of each cartridge 33 is provided with a laser scanner unit 11 as an image exposure device. The unit 11 includes a laser diode, a polygonal mirror, an Fθ lens, a reflection mirror, and so on. The unit 11 outputs the laser beams L (LY, LM, LC, LK) modulated correspondingly to the Y, M, C, K image information inputted to the control circuit portion 300 from a host apparatus 400 to scanningly expose the drum 32*a* in the cartridge 33 of the corresponding color.

(Recording Material Feeding Mechanism)

A lower portion of the image forming unit 200 is provided with a feeding unit 18. The unit 18 includes a feeding cassette 19 for stacking recording material S, a feeding roller 20, a separation pad 21, and so on. A cassette 19 is taken in and out of the front side of the main assembly 100A (insertion and detachment) (front loading). In the main assembly 100A, between the transfer member 34 and a rear frame 110*b* of the main assembly 100A, there is provided a recording material feeding path Z extended from a roller 20 to a backside upper portion in the main assembly 100A. Along the feeding path Z from the bottom to the top, a registration roller couple 18*a*, a secondary transfer roller 22, a fixing device 23, and a discharging roller pair 24 are provided in the order named. The fixing device 23 is provided with a fixing film unit 23*a* and a pressing roller 23*b*. The discharging roller pair 24 includes a discharging roller 24*a* and a discharging roller 24*b*. An upper surface of the main assembly 100A is provided with a discharging tray 100*c* for receiving a recording material on which the image has been formed S. A cover 10 is an opening and closing member for opening and closing an opening portion 100B provided in the front side of the main assembly 100A. To the cover 10, the unit 11 is mounted. The opening portion 100B is an opening for mounting and demounting the cartridge 33 relative to the unit 200, as will be described hereinafter. Therefore, the user enables the mounting and demounting of the cartridge 33, by moving the cover 10 which holds the unit 11 to the open position.

FIG. 1B shows the state that the apparatus is capable of image forming operation 100. In this state, the cover 10 is placed in the closed position G for closing the opening portion 100B. The unit 200 is loaded with each cartridge 33, and is placed in an image forming position A for carrying out an image formation relative to the main assembly 100A. A driving force outputting portion (unshown) provided in a main assembly (100A) side couples with a gear 34*b* (FIGS. 6A and 6B) which is a drive inputting portion of the transfer member 34 of the unit 200. An electric power supply system (unshown) provided in the main assembly (100A) is electrically connected to an electrical contact (unshown) of each unit 32 and cartridge 33. Here, the driving system and the bias voltage application type described above are omitted in the Figure for the sake of simplicity. As for them, the structure similar to the case of the normal image forming apparatus can be employed.

The operation for forming a full-color image will be described. Referring to FIG. 1B, and FIG. 2, the description will be made. Each drum 32*a* is rotationally driven in a counter-clockwise direction of the arrow at a predetermined speed. The roller 32*b* is driven with the drum 32*a* by the drum 32*a* being rotationally driven. The transfer member 34 is rotationally driven at the speed corresponding to the speed of the drum 32*a* in the clockwise direction (codirectional with the rotation of the drum 32*a*) of the arrow. The developing roller 33*b* and the supplying roller 33*d* are rotationally driven at the predetermined speeds in the clockwise directions of the arrows, respectively. The scanner unit 11 is driven. In synchronism with this drive, a predetermined charging bias voltage is applied to each charging roller 32*b* at predetermined control timing. By this, the surface of the drum 32*a* is uniformly charged by the charging roller 32*b* to the predetermined polarity and predetermined potential. The unit 11 scanningly exposes the surface of each drum 32*a* with the laser beams L (LY, LM, LC, LK) modulated as described above. By this, the electrostatic latent image corresponding to the correspondence color image signals is formed on the surface of the drum 32*a* of each cartridge P. The electrostatic latent image formed on the surface of each drum 32*a* is developed into the developer image by the developing roller 33*b* of the corresponding cartridge 33. The developing roller 33*b* is supplied with a predetermined developing bias voltage at the predetermined controlled timing.

Through the above-described electrophotographic image forming process operation, a Y color developer image corresponding to a yellow component of the full-color image is formed on the drum 32*a* opposed by a cartridge 33Y. The developer image thereof is transferred (primary transfer) onto the transfer member 34 in a primary transfer nip 34*b* which is a contact portion between the drum 32*a* and the transfer member 34. An M color developer image corresponding to a magenta component of the full-color image is formed on the drum 32*a* opposed by a cartridge 33M. The developer image thereof is transferred (primary transfer) onto the color developer image already transferred onto the transfer member 34 in a nip 34*b* Y. A C color developer image corresponding to a cyan component of the full-color image is formed on the drum 32*a* opposed by a cartridge 33C. The developer image thereof is transferred (primary transfer) onto the color+M color developer image already transferred onto the transfer member 34Y in the nip 34*b*. A K color developer image corresponding to a black component of the full-color image is formed on the drum 32*a* which the cartridge 33K opposed. The developer image thereof is transferred (primary transfer) onto the color+M color+C color developer image already transferred onto the transfer member 34 Y in the nip 34*b*.

In this way, a full-color developer image of the Y color+M color+C color+K color is synthetically formed on the transfer member 34. An order of the colors of the developer images transferred is not limited to the above described order. In each drum 32*a*, an untransferred developer which remains on a drum surface after the primary transfer of the developer image relative to the transfer member 34 is removed by the blade 32*c*. The removed developer is fed to a residual developer accommodating container 40 (FIG. 10, FIG. 11) through a screw (developer feeding member) 32*e*.

On the other hand, the feeding roller 20 is driven at the predetermined controlled timing. In this manner, by a cooperation of the feeding roller 20 and the separation pad 21, the separation and feeding of the sheet-like recording materials S stacked in the cassette 19 is carried out one by one. The recording material S thereof is introduced to a secondary transfer nip 34*c* which is the contact portion between the transfer member 34 and a roller 22 at the predetermined control timing by a roller pair 18*a*. The transfer roller 22 is supplied with the secondary transfer bias voltage of the predetermined potential having the polarity opposite to that of the charge polarity of the developer at the predetermined controlled timing. By this, the four-color-superimposed developer image on the transfer member 34 is sequentially transferred (secondary transfer) onto the surface of the recording material S in the process in which the recording material S is nipped and fed through the nip 34*c*.

The recording material S which passed the nip 34*c* is separated from the surface of the transfer member 34, is introduced to the fixing device 23, and is heated and pressed by a fixing nip. By this, the color developer images are mixed and fixed on recording material S. The recording material S is discharged onto the cover 10 functioning also as the discharging tray by the roller pair 24 as a full-color print from the fixing device 23. The toner remaining after the secondary transfer remaining on the surface of the transfer member 34 after the separation of the recording material S from the transfer member 34 is removed. In the case of this embodiment, the toner is electrostatically deposited onto the surface of the drum 32*a* in the primary transfer nip 34*b* in the unit 32Y between the drum 32*a* and the transfer member 34, and, and then it is removed by the cleaning blade 32*c*.

The transfer member 34 is the rotatable member of a drum configuration. The different color developer images formed on the drums 32*a* is superimposedly transferred onto the transfer member 34. The developer images transferred superimposedly is transferred all together onto the recording material S from the transfer member 34. By this, the color image is formed on the recording material S. In the case where a monochromatic image is to be formed, the color developer image K formed on the drum 32*a* to which the cartridge 33K is opposed is transferred onto the transfer member 34. The transferred black developer image is transferred onto recording material S from the transfer member 34. By this a K color image is formed on the recording material S. In this embodiment, the roller 22 is movable between a first position for contacting to the transfer member 34 and forming the nip 34*c* and a second position remote from the transfer member 34 by a shifting mechanism (unshown). At the time of an image forming operation of the apparatus 100, the secondary transfer roller 22 is moved to the first position, and at the time of then on-image formation, it is moved to the second position. The transfer roller 22 may normally be contacted with the intermediary transfer member 34.

(Image Forming Unit)

Referring to FIG. 6A and FIG. 6B, the structure of the unit 200 will be described. FIG. 6A is a perspective view of the unit 200, as seen from left-hand side, and (b) is a perspective view, as seen from right-hand side. The unit 200 is provided with the sub-frame 31 detachably mountable relative to a main frame 110 (FIG. 1A) of the main assembly 100A. A frame 31 rotatably supports a cylindrical base member and an intermediary transfer member 34 which is provided with an elastic member which coats the peripheral surface thereof. The left-hand end portion and the right-hand end portion of the center shaft (rotation shaft) 34*a* of the transfer member 34 are rotatably supported between a left side plate 31L and a right side plate 31R of this frame 31. A left shaft portion 45L and a right shaft portion 45R are fixed integrally to the outer surface of the side plates 31L, 31R co-axially with the center axis 34*a* of the transfer member 34. The right-hand end portion of the transfer member 34 is provided with a gear 34*b* which transmits the driving forces to the drums 32*a* to transmit the driving force transmitted from a main assembly driving source (unshown) to the drum gears 32*a*1.

About the transfer member 34, the units 32 (32Y, 32M, 32C and 32K) are disposed, so that the drums 32*a* are contacted to the transfer member 34. Each of the unit 32 is positioned relative to the frame 31 by a positioning structure (unshown), and is fixed by screws or the like thereto. By this, the drum 32*a* and the transfer member 34 of each unit 32 can be positioned relative to each other with high precision. Each drum 32*a* is in contact to the transfer member 34 with a predetermined urging force. Each unit 32 is inserted and fixed in the direction of the arrow X1 relative to the frame 31. At this time, the discharging portion 32*f* provided at the left-hand end portion of each unit 32 is inserted into the frame 31 through the associated opening portion 31*k* provided in the left side plate 31L of the sub-frame 31. The discharging portion 32*f* is provided in the frame 31, and projects outwardly beyond the left side plate 31L. By the provision of the opening portion 31*k*, with the discharging portion 32*f* projected in the axial direction of the drum 32*a*, the unit can be mounted in the direction perpendicular to the axis of the drum 32*a*.

The right side plate 31R of the frame 31 is provided with the portion-to-be-regulated 311 for regulating a rotation of the unit 200 in the main assembly 100A. The unit 200 is positioned in the main assembly 100A by the left shaft portion 45L, the right shaft portion 45R, and the portion-to-be-regulated 311. The details thereof will be described hereinafter. The left shaft portion 45L, the right shaft portion 45R, and a portion-to-be-regulated-in-rotation 311, which is a positioning portion in the main assembly 100A of the transfer member 34 are provided on the sub-frame 31. By this, the position of the transfer member 34 in the main assembly 100A is determined with high precision. As has been described in the foregoing, each photosensitive member unit 32 fixed to the frame 31 is provided with the mounting portion 321, for dismountably mounting the cartridge 33. A function of each mounting portion will be described hereinafter.

(Image Forming Unit Mounting Portion)

As shown in FIG. 7, a left-hand side guiding plate 80L and a right-hand side guiding plate 80R is provided opposed to the inside of a left-hand side frame 110L of the main assembly 100A and the inside of a right-hand side frame 110R fixedly. The each of the guiding plates 80L, 80R is provided with a positioning portion 80*a* which rotatably supports the shaft portion 45L, 45R of the frame 31 and a guide portion 80*b* for guiding the shaft portions 45L, 45R to the positioning portion 80*a*. The right-hand side guiding plate 80R is provided with a rotation regulating portion 80*c* which is continuous with the guide portion 80*b*, and the portion-to-be-regulated-in-rotation 311 provided on the unit 200 described above contacts to it to regulate the rotation of the unit 200.

(Mounting of Image Forming Unit)

The description will be made as to the mounting of the unit 200 into the main assembly 100A. A bottom end of the cover 10 is rotatably coupled to the main assembly 100A through a hinge shaft 10*a* (FIG. 1B). The cover 10 is movable between the closing position for closing the opening portion 100B of a side surface of the main assembly 100A G (FIG. 1B) and the open position for opening the opening portion 100B H (FIG.

7). More particularly, the cover 10 is opened and closed relative to the opening portion 100B in the side of the main assembly 100A about the hinge shaft 10*a*. as shown in FIG. 8, the closing position (closed position) G of the cover 10 is maintained by the engagement (latch engagement) between a locking claw portion 36*a* provided on the maintenance button (36) provided at front side of the main assembly 100A and a locking claw portion 10*b* provided in the cover (10) side. The locking claw portion 36*a* is the main assembly side locking portion, and the locking claw portion 10*b* is an opening and closing member side locking portion. The closure releasing of the cover 10 is carried out by the user pushing a button 36. When the button 36 is pushed rearwardly against the elastic force of the return spring (unshown), the button (36) side locking claw portion 36*a* escapes from the locking claw portion 10*b* of the cover 10 rearwardly to release the latch engagement, as indicated by the chain line. By this, the cover 10 is rotated to the open position H about the hinge shaft 10*a*, so that n the opening portion 100B can greatly be opened ((b) of FIG. 8). In this embodiment, the locking claw portion 36*a* and the locking claw portion 10*b* is elastically locked releasably. However, this embodiment is not limited to this example. For example, the claw (locking portion) provided on one side may be elastically and releasably locked with the hole (locking portion) provided in another side.

As shown in FIG. 9A, the mounting, into the main assembly 100A, of the unit 200 rotates the cover 10 to the open position H, and greatly opens the opening portion 100B. The user inserts the unit 200 into the main assembly 100A from the opening portion 100B. The unit 200 engages the left and right shaft portions 45L, 45R with the guide portion 80*b* opposed and provided to the left and right guiding plates 80L, 80R of the main assembly (100A), and inserts them, respectively. In this manner, the unit 200 is mounted into the main assembly 100A. Thereafter, the shaft portions 45L, 45R are contacted to the positioning portion 80*a* provided on the extension of the guide portion 80*b* (FIG. 9B). At this time, the gear 34*b* (FIG. 6A) provided at the one-end portion of the transfer member 34 engages with a driving gear (unshown) provided in the main assembly 100A. Thereafter, the cover 10 is rotated to the closing position G to complete the mounting of the unit 200 into the main assembly 100A. When the cover 10 is rotated to the closing position G, the locking claw portion 10*b* engages with the locking claw portion 36*a* which is the main assembly side locking portion to be maintained in the closing position G ((a) of FIG. 8).

(Removed-Developer Accommodating Container)

Part (a) of FIG. 10 is a right-hand side perspective view of the removed-developer accommodating container (removed-developer accommodating portion) 40, (b) is a left-hand side perspective view, and (c) is a sectional view taken along the section line A-A of (a). As has been described in the foregoing, in each of the unit 32 (32Y, 32M, 32C, 32K), the developer which remains on the surface of the drum 32*a* is removed by a blade (cleaning member) 32*c*. The removed developer is fed in the feeding direction by a screw (feeding member) 32*e*. The fed developer is accommodated into the container 40 dismountably mounted to the left-hand end portion of the unit 200 which is the downstream side of the screw 32*e* with respect to a feeding direction.

The container 40 comprises an accommodating container 41 and a cover 42, which are unified by the welding and so on. The container 41 is provided with a removed-developer receiving openings 41*a* correspondingly to the respective units 32. As shown in FIG. 2, in this embodiment, the drums 32*a* are disposed at intervals along the peripheral surface of the intermediary transfer member 34. Therefore, the receiving side openings (opening) 41*a* are similarly disposed along the peripheral surface of the transfer member 34 ((c) of FIG. 10, (a) of FIG. 14). Each opening 41*a* is provided in the recess 41*b* formed on the container 41. A recess 41*b* has the sufficient size to permit a passage of the discharging portion 32*f* of the unit 32. The circumference of each opening 41*a* is provided with a sealing member 43 which contacts with the discharging portion 32*f* and which prevents the scattering of the developer to the outside. The sealing member 43 is fixed by the double coated tape and so on to the container 41. The sealing member 43 is provided with the opening which has the size and the configuration which are substantially the same as those of the opening 41*a*. The lower side of the opening 41*a* is provided with an accommodating portion 41*c*, which contains the residual developer received through the opening 41*a*. More particularly, the accommodating portions 41*c* are connected with each other inside in order to store the developer supplied through the openings 41*a* all together. Therefore, space efficiency is good, as compared with the case in which accommodating portions are provided in accordance with each opening portions. The right side part of the container 41 is provided with the portions-to-be-guided 41*d*, 41*e*, and 41*f* for mounting the container 40 to the unit 200. The container 40 is mounted and positioned to the unit 200 through the portions-to-be-guided 41*d*, 41*e*, and 41*f*. The cover 42 is provided with the grip 42*a* for mounting and demounting the container 40 relative to the unit 200. The grip 42*a* is provided by forming the recess in the cover 42. When an amount of the residual developer more than a predetermined amount is contained in the container 40, the user grips the grip 42*a* and dismounts the container 40 from the unit 200 to exchange it with a new container. Or, after the residual developer in the container 40 is discarded, the container 40 thereof may be re-used. The container 40 is provided with the grip 42*a* for mounting and demounting it relative to the main assembly 100A, and therefore, a mounting and dismounting operation is easy.

(Mounting of Removed-Developer Accommodating Container to Image Forming Unit)

The container 40 is mounted and demounted in the state of being placed in the position of FIG. 9B, and (b) of FIG. 13 in the direction (the direction perpendicular of the direction relative to the axis of the drum 32*a*) of the arrow X3. As shown in FIG. 6A, and (a) of FIG. 11, an outside surface of the left side plate 31L of the sub-frame 31 is provided with the guide portions 31*m* 1 or 31*m* 2 or 31*m*3. The portions-to-be-guided 41*d*, 41*e*, 41*f* provided in the container 40 is inserted in the direction of the arrow X3 along the guide portions 31*m* 1 or 31*m* 2 or 31*m*3. The guide portion 31*m*2 is provided with a leaf spring (elastic member, locking portion) 49 therein. After a portion-to-be-guided 41*e* is received, a spring 49 urges the portion-to-be-guided 41*e* by the elastic force in the arrow X4. The portion-to-be-guided 41*e* is urged by the elastic force of the spring 49. In this manner, the portion to be positioned 41*e*1 ((a) of FIG. 10) of the guide portion 41*e* is abutted to a positioning portion 31*m*4 provided at a trailing end of a guide portion 31*m*2 to effect the positioning in the front-rear direction. Since the width of an up-down direction of the guide portion 41*e* is substantially the same as that of the width of the up-down direction of the guide portion 31*m*2, the positioning in the up-down direction is also simultaneously effected. Furthermore, a movement in the direction opposite the direction of the arrow X3 is prevented by the spring 49. Therefore, the guide portion 41*e* does not disengage to the outside of the unit 200 (out of main assembly). Here, the elastic force of the spring 49 functions for the locking of the container 40 relative to the unit 200. The guide portion 31*m*2 functions as a portion-to-be-locked 31*m*2 to be locked to a locking portion 49. As has been described in the foregoing, the container 40 is dismountably mounted to the unit 200 ((b) of FIG. 11). As has been described in the foregoing, the unit 200 is provided with the guide portions 31*m* 1 or 31*m* 2 or 31*m*3 for mounting and demounting the container 40 relative to main assembly 100A (unit 200). The container 40 is provided with the portions-to-be-guided 41*d*, 41*e*, and 41*f* to be guided by the guide portions 31*m* 1 or 31*m* 2 or 31*m* 3. In this manner, the mounting and demounting of the container 40 relative to the unit 200 can stably be carried out. The guide portion 31*m*1 guides the portion-to-be-guided 41*d*, the guide portion 31*m*2 guides the portion-to-be-guided 41*e*, and a guide portion 31*m*3 guides a portion-to-be-guided 41*f*.

By this series of mounting operations, the container 40 moves the shutter 32*g* ((b) of FIG. 4) provided in each unit 32 to the open position by an actuator (unshown). When the mounting is completed, the opening 41*a* provided in the container 40 opposes to the supply side opening 32*g*1 provided in the unit 32. Therefore, the opening 41*a* can receive the residual developer fed by the screw 32*e*. As has been described in the foregoing, the unit 32 and the container 40 are directly coupled with each other.

The means to feed the residual developer to the container 40 is only the screw 32*e*. Furthermore, the container 40 adjoins the cartridges 33 disposed adjacent to each other along one direction X20 ((a) of FIG. 13), and is provided along one direction X20 so as to overlap with the cartridges 33 partially as seen in the direction of the axis. Therefore, the main assembly 100A is free from a complicated structure for feeding the residual developer into the container (accommodating portion) 40. Therefore, the structure of the main assembly 100A can be simplified. Furthermore, the simplification of the structure downsizes the main assembly 100A.

FIG. 14 is a sectional view illustrating the state that the opening 41*a* and an opening 32*g*1 are in engagement with each other. Part (a) is a general arrangement, and (b) is a detailed view. The size H2 of the opening 41*a* is larger than the size H1 of the opening 32*g*1. According to this embodiment, a diameter H1 is approx. 10 mm, and a diameter H2 is approx. 20 mm. The size of H2 is 1.05-2 times the size of H2, preferably. With such structures, even if the relative position between the opening 41*a* and an opening 32*g*1 varies due to the individual differences, the opening 32*g*1 can overlap with the opening 41*a* assuredly. Therefore, the supplied residual developer is acceptable without the leakage to the outside. As has been described in the foregoing, the size H2 of the opening 41*a* is larger than the size H1 of the opening 32*g*1. In this manner, even if the openings 41*a* deviate corresponding to the dispositions of the drums 32*a*, and therefore, the positional accuracies between the openings 41*a* tend to vary, the variation in the positional accuracy of the openings 41*a* is accommodated to collect the residual developer assuredly. It is preferable to change a difference between H1 and H2 in accordance with the settings (tolerances) of respective types. By such a structure employed, the complicated structure for preventing the leakage of the residual developer is unnecessary. Therefore, the structure of the main assembly 100A can be simplified. Furthermore, the downsizing of the main assembly by the simplification of the structure is also possible. An elastic seal member 43 provided around each opening 41*a* is placed between the opening 41*a* and the opening 32*g*1. In this manner, as has been described in the foregoing, although the size H2 of the opening 41*a* is larger than the size H1 of the opening 32*g*1, the developer does not leak through the gap between the openings (FIG. 10). More particularly, in storing the developer removed from the photosensitive drums 32*a* in a common container 41, the leakage of the developer can be suppressed.

As the material of the sealing member 43, the elastic member or flexible member such as a felt, a rubber, and a flocked material can be used. In this embodiment, the sealing member 43 is provided around the opening 41*a*. Therefore, even if the diameter of the opening 41*a* is larger than the diameter of the opening 32*g*1, the developer can be guided into the container 41 without leakage. However, the sealing member 43 may be provided around the opening 32*g*1. When the sealing member 43 is provided on the container 41 portion, a lifetime of the sealing member 43 can be shortened, as compared with the case in which it is provided in the opening 32*g*1. This is because the container 41 will be exchanged whenever it becomes full. The configuration of the openings 41*a*, 32*g*1 may be suitably selected by the person skilled in the art.

Part (a) of FIG. 13 is a perspective view illustrating the state of mounting the container 40 to the unit 200, and (b) thereof is a perspective view illustrating the state (or before mounting the container 40) of taking out the container 40 from the unit 200. The container 40 is provided adjacent to each other along the direction (arrow X20) in which the plurality of cartridges 33 (33Y, 33M, 33C, 33K) are disposed adjacent to each other over the plurality of cartridges 33. More particularly, as shown in (b) of FIG. 13, the container 40 overlaps with the cartridges 33 partially as seen in the axial direction of the drum 32*a*. Therefore, the container 40 can be provided with the minimum spacing expansion in the direction of the arrow X21 perpendicular to the direction of the arrow X20.

When exchanging the container 40, the user dismounts it from the unit 200, while the user grips the grip 42*a*, as has been described in the foregoing. In response to the operation which dismounts the container 40, an opening of the unit 32 is shut by a spring member (resilient member) of the shutter 32*g*. On the other hand, the member such as a shutter is not provided for the opening 41*a* of the container 40 in order to suppress a cost. However, in a mounting and demounting direction (the direction X3 in (a) of FIG. 13 and the opposite direction thereto) the opening 41*a* does not face down with respect to the direction of gravity. Therefore, the leakage of the residual developer can be minimized without the provision of a member such as the shutter. Furthermore, the unit 32 and the container 40 are directly coupled with each other. Therefore, the number of the positions in which the residual developer may leak s decreases and the leakage of the developer can be suppressed in such a sense.

In this embodiment, the shutter or the like is not provided for the opening 41*a*. However, even if the shutter which openably and closably blocks the opening 41*a* is provided, the leakage of the removed developer through the shutter can be suppressed as much as possible. Since the container 40 is detachably mountable relative to the unit 200, the user can carry out the exchange of the cartridge 33 and the exchange of the container 40 through the same method. Therefore, this embodiment is excellent in the usability. The mounting and demounting direction of the container 40 and the mounting and demounting direction of the cartridge 33 as will be described hereinafter are the same. Therefore, the user can carry out both operations easily. Here, the same direction is not in the strict sense, but the directions may slightly be deviated, if the mounting and demounting of the container 40 and the cartridge 33 can be performed, without changing the position of the unit 200. Furthermore, the container 40 and the cartridge 33 can be mounted and demounted individually. In other words, they are disposed, so that it does not overlap in the mounting and demounting direction (the direction of the arrow X3 of FIG. 9B, and the opposite direction thereto). The guide portions 31*m* 1 or 31*m* 2 or 31*m*3 of the unit 200 which support the container 40 are provided on the outside surface of the frame 31. Therefore, it is not necessary to provide the accommodating space for accommodating the container 40 in the frame 31, and therefore, the downsizing of a device can be accomplished. The mounting position of the container 40 is in the non-driving side opposite from the driving side which is provided with the driving system (driving force transmitting portion) such as the drum gear (32*a*1) and the feeding gear (32*i*) with respect to the axial direction of the drum 32*a*. Therefore, the latitude in the disposition of the driving system is enhanced, and as a result, the downsizing of the device is accomplished.

(Mounting of Cartridge)

The description will be made as to the mounting and demounting of each cartridge 33 33Y, (33M, 33C, 33K) relative to the unit 200. First, the cover 10 is moved from the closing position G which closes the opening portion 100B to the open position H which opens the opening portion 100B.

The user grips a first grip 39 (FIG. 2) provided on the cartridges 33 33M, (33C, 33K) and a part of case 33*a*. As for the cartridge 33Y, the user grips the first grip 39 and a flat surface portion 38*a* (FIG. 5) of the second grip 38. Or, only the second grip 38 is gripped. Each cartridge 33 is mounted to the corresponding mounting portion 321 of the unit 200. The mounting direction is the direction perpendicular to the rotation axis of the roller 33*b*. More particularly, as shown in FIG. 12A the cartridge 33 side portions-to-be-guided 33*e*1, 33*e*3 are inserted into the unit 200 side mounting portion 321. FIG. 12A shows the case of the mounting of the cartridge 33Y. It is inserted into the mounting portion 321 in the case of the mounting of the cartridge 33Y. Subsequently, the portions-to-be-guided 33*e*2, 33*e*4 is inserted. The portion-to-be-guided 33*e*1-33*e*4 is guided by the mounting portion 321, and it is inserted into the inside toward the drum 32*a*. The portions-to-be-guided 33*e*1, 33*e*3 are abutted to the regulating member 36 provided in the mounting portion 321. The regulating member 36 in this embodiment is an L-shape member, and contacts the portions-to-be-guided 33*e*1, 33*e*3 to the L-shape portion. The regulating member 36 is pushed up by the elastic force of an elastic member 37 in a free state. In this manner, in the state that the regulating member 36 (L-shape portion) is in the recess 321*a* of the mounting portion 321, the upper surface thereof is abutted to and received by a ceiling surface of the recess 321*a*. In this state, the position of the regulating member 36 is a regulation position D. When the cartridge 33 is further inserted, the portions-to-be-guided 33*e*1, 33*e*3 uses the L-shape portion of the regulating member 36 as a cam slope, and pushes the regulating member 36 down against the elastic force of the elastic member 37 elastically urged upwardly. By this, the regulating member 36 is pushed down in the direction (arrow X5) of retracting from the recess 321*a* of the mounting portion 321, so that the portions-to-be-guided 33*e*1, 33*e*3 enters between the upper surface of the regulating member 36 and the ceiling surface of the recess 321*a*. The push-down position of the regulating member at this time 36 is a permitting position E where the mounting and demounting of the cartridge 33 is permitted. In this manner, the portions-to-be-guided 33*e*1 and 33*e*3 enter a rear side of the recess 321*a* beyond the regulating member 36. The portions-to-be-guided 33*e*2, 33*e*4 is also entered to the recess 321*a* of the mounting portion 321. By this, the mounting, into the unit 200, of the cartridge 33 is completed.

The main assembly 100A is provided with a cartridge urging member 51*a*-51*d* for elastically urging each cartridge 33 toward the corresponding unit 32 in the state that the unit 200 is placed in image forming position A (FIG. 1A, FIG. 12A). The urging members 51*a*-51*d* are provided at a longitudinal end and the other longitudinal end of the cartridge 33, and each of the cartridges is provided with the two urging members (FIG. 13). The urging members 51*a*-51*d* are provided on the inside of the door 10. Therefore, in interrelation with the closing operation of the door 10, they are sequentially contacted to the rear end portion of each cartridge 33 in the order of 51*d*, 51*c*, 51*b*, 51*a*. as shown in FIG. 1B, when the unit 200 is placed in the image forming position A, the cartridge 33 is elastically urged in the direction of the arrow Y2 by the urging members 51*a*-51*d*. The roller 33*b* of the cartridge 33 contacts the regulation rollers (unshown) provided at the opposite ends thereof to the drum 32*a*. In this manner, the roller 33*b* is contacted, with the predetermined elastic force (urging force), to the drum 32*a*. The urging force by the urging member 51 can satisfactorily maintain the contact state (or spacing state) between the developing roller 33*b* and a drum 32*a*. <0476>INVENTION:

By the above-described operation, the device 100 becomes in the state that an image forming operation (print operation) can be carried out, and the image forming operation described above is carried out on the basis of an image formation start signal (print start signal). More particularly, the main assembly (100A) side drive outputting portion (unshown) couples with the gear 34*b* of the transfer member 34 of the unit 200 placed in the image forming position A (drive inputting portion). The drum gear 32*a*1 of each unit 32 couples with the gear 34*b*. The gear 50 of the roller 33*b* of each cartridge 33 couples with the gear 34*b*. The electric power supply system of the main assembly side is electrically connected to the electrical contacts of the photosensitive member units 32 and the cartridges 33. By this, the image forming apparatus 100 is capable of carrying out the image forming operation.<0484>INVENTION:

In this embodiment, the scanner unit 11, the cartridge 33, the drum 32*a*, the transfer member 34, and the feeding path Z for the recording material S are disposed substantially in parallel with the installation surface F, as shown in FIG. 1B. The upper portion of the apparatus 100 is provided with the discharging tray 100*c*, and the lower portion of the apparatus 100 is provided with the cassette 19. The laser beams L (LY, LM, LC, and LK) are projected from the unit 11 to the drum 32*a* in the rear part of the cartridge 33. The color developer image transferred onto the transfer member 34 from each drum 32*a* is transferred onto recording material S in the opposite side from each drum 32*a* with respect to the transfer member 34.

(Cartridge, Removed-Developer Accommodating Container (Exchange of Removed-Developer Accommodating Portion))

In each of the cartridges 33 (33Y, 33M, 33C, 33K), the developer contained in the accommodating portion 33*c* of the cartridge 33 is consumed as it is used for the image formation. Means unshown for detecting a developer remainder of each cartridge 33 is provided, and the control circuit portion 300 compares a detected remaining amount value with the threshold for the lifetime forenotice and a lifetime warning of a cartridge set beforehand. As for the cartridge 33 in which the detected remaining amount value became less than the threshold, a lifetime forenotice or a lifetime warning of the cartridge 33 thereof makes it display on a display portion 102 (FIG. 1A) provided in an operating portion 101 of the apparatus 100. Or, it is displayed on a display portion (unshown) of the host apparatus 400. By this, the user is prompted to the preparation of the cartridge for the exchange or exchange of the cartridge. Also with respect to the container 40, it is detected that the inside of the container contains the residual developer more than the predetermined level, and the event is displayed on the display portion 102 and so on to prompt the user to the exchange of the container 40.

In the apparatus 100 of this embodiment, in the exchange of each cartridge 33 and the container 40 mounted to the unit 200, the user opens the cover 10 to open the front opening 100B of the main assembly 100A. As shown in FIG. 1B, for the closure releasing of the cover 10 locked at the closing position G, the user pushes a maintenance button 36 on the front side of the main assembly 100A, as shown by the chain lines in (a) of FIG. 8. When the user pushes the button 36 downwardly against the spring (unshown), the button (36) side locking claw portion 36*a* escapes from the cover (10) side locking claw portion 10*b* rearwardly to release the latch engagement, as indicated by the chain line. In this manner, the cover 10 is rotated in the open direction from the main assembly 100A by an angle corresponding to an operation distance (the restoration length to the free length) of the urging member 51*a*-51*d* about the hinge shaft 10*a*. More particularly, the cover 10 becomes in a partly open state automatically by the elastic force of the urging member 51*a*-51*d*. However, even if at user does not constrain the cover 10 at this point of time, the cover 10 does not rotate downwardly by the gravity, since a gravity center of the unit 11 is placed in the main assembly (100A) side from a center of the hinge shaft 10*a*. Part (b) of FIG. 8 shows the partly open state of the cover 10. Thereafter, when the user lifts the finger from the button 36, the force (elastic force) of the urging spring (unshown) restores it to the previous position. At this time, the locking claw portion 10*b* is placed in the side by the partially open movement of the cover 10, and therefore, it does not engage with the restored locking claw portion 36*a* ((b) of FIG. 8). The user touches the finger on a grip (grip portion) 10*d* of the cover 10 which is in the partly opening state and manually opens the cover 10 to the open position H as shown in FIG. 12B, and (a) of FIG. 13. The cover 10 is sufficiently opened to the open position H and contacts a part of a main assembly 100A or the desk, so that the stable state is maintained. By this, the opening portion 100B is sufficiently greatly opened. In this state, the cartridge 33 and the container 40 are dismounted in the direction opposite to the mounting direction described above. A portion-to-be-locked (guide portion) 31*m*2 of the container 40 disconnect from the locking portion (the elastic member, the urging member) 49 in interrelation with the dismounting work. In this manner, the container 40 can be taken out to an outside of the unit 200. The container 40 is provided with discrimination means which shows that it is not a cartridge 33. Therefore, the cartridge 33 and the container 40 carried on the same unit 200 are not mixed up, when the user exchanges them. The discrimination means may be any, if the user can discriminate it visually, and the container 40 and the cartridge 33 may be provided with the different labels, for example. Or, an outer appearance of the container 40 may be different from that of the cartridge 33. The container 40 may be a transparent container, and in this case, the user can recognize easily that the residual developer is contained in the inside. The combination of these examples accomplishes the assured discrimination.

In this embodiment, the transfer member 34 is the intermediary transfer member for transferring the image indirectly onto the recording material S from the drum 32*a*. However, this is not inevitable, and it may be of the type of transferring the image directly onto the recording material S from the drum 32*a*. At this time, the transfer member 34 transfers the developed image directly from the drum 32*a* onto the recording material S. In this embodiment, the cartridge which is to be exchanged is the developing cartridge 33 used for the process cartridge of the discrete type. However, this is not restrictive, and the cartridge which is to be exchanged may be the process cartridge which unifies a photosensitive unit 32 and developing cartridge 33.

Embodiment 1 is summarized as follows. The apparatus is an electrophotographic color image forming apparatus 100 for forming a color image on recording material S. The electrophotographic image forming apparatus 100 is provided with the plurality of electrophotographic photosensitive drums 32*a*. It is provided with the cartridge 33, wherein the cartridge 33 contains the developer and is detachably mountable in the direction X3 perpendicular to the axis of the drum 32*a* relative to the main assembly 100A of the apparatus 100. The electrophotographic image forming apparatus 100 is provided with a cartridge mounting portion 321 for mounting the cartridge 33. The electrophotographic image forming apparatus 100 is provided with a plurality of cleaning members 32*c* for removing the developer which remains on the surfaces of the plurality of drums 32*a*. The electrophotographic image forming apparatus 100 is provided with the residual developer container (removed-developer accommodating portion) 40, which contains the developer removed by the a plurality of cleaning members 32*c*, and which is detachably mountable relative to the main assembly 100A in the direction X3 perpendicular to the axial direction of the drum 32*a*. The cartridges 33 are disposed adjacent to each other in one direction X20. The container 40 adjoins the plurality of cartridge 33, and it overlaps at least partially with the plurality of cartridges (including drum 32*a*) as seen in the direction of the axis ((b) of FIG. 11). In this manner, even if the container 40 is mounted to the main assembly 100A, the height or the depth of the apparatus 100 does not increase. Here, the depth is the dimension of the cartridge 33 in the mounting direction. As to the widthwise direction of the container 40, the width of the apparatus 100 is not always increased, when the dead space in the apparatus can effectively be utilized. Therefore, the container 40 can be efficiently disposed in the main assembly 100A. This is because the height and the depth of the container 40 are within the limits of the height and the depth of the cartridges 33 mounted. In this embodiment, the whole container 40 overlaps with the four cartridge s (drum 32*a*), as seen in the direction of the axis, and therefore the effect described above can sufficiently be provided. However, the present invention is not limited to this. The effect described above can be provided if the container 40 overlaps at least partially with the plurality of cartridges, as seen in the direction of the axis. According to this embodiment, there is provided the screw for feeding the developer removed by the cleaning blade (cleaning member) 32*c* in the axial direction of the electrophotographic photosensitive drum (32*a*) (developer feeding member) 32*e*. The container 40 is provided in the downstream side of the feeding direction of the screw 32*e*. Therefore, according to this embodiment, also from this standpoint, the container 40 can be efficiently disposed in the main assembly 100A. This is because, according to the disposition, the removed developer removed from the drum 32*a* can be fed to the container 40 through the short feeding path. The developer removed from the plurality of photosensitive drums 32*a* can be accommodated into the common container 40. Therefore, as compared with the case in which the plurality of containers are mounted and demounted, the space occupied by the structure which the mounting and demounting of the container 40 takes can be reduced. The mounting and demounting direction of the container 40 is the same as the mounting and demounting direction of the cartridge 33.

Therefore, the operativity when the user carries out the mounting and demounting of the container 40 and the cartridge 33 can be improved.

The apparatus 100 is provided with the feeding member 32*e* for feeding the developer removed by the cleaning member 32*c* in the axial direction of the drum 32*a*. The container 40 is provided in the downstream side in the feeding direction of the feeding member 32*e*. The mounting and demounting direction of the container 40 is the same as the mounting and demounting direction of the cartridge 33. The container 40 is provided with the grip 42*a* gripped by the user, when it is mounted and demounted relative to the main assembly 100A. The main assembly 100A is provided with the guide portions 31*m* 1 or 31*m* 2 or 31*m*3 for mounting and demounting the container 40 relative to the main assembly 100A. The container 40 is provided with the portions-to-be-guided 41*d*, 41*e*, 41*f* guided by the guide portions 31*m*1, 31*m*2 or 31*m*3. The end of the feeding member 32*e* is provided with the drive transmitting portion 32*i* for transmitting the driving force to the feeding member 32*e*. The container, 40 is provided at the side opposite from the side which is provided with the driving force transmitting portion 32*i* with respect to the axial direction of the drum 32*a*.

The main assembly 100A is provided with the locking portion 49 for preventing the disengagement, from the main assembly 100, of the container 40 by fixing the container 40. The container 40 is provided with the portion-to-be-locked 31*m*2 locked by the locking portion 49. In dismounting the container 40, the portion-to-be-locked 31*m*2 disconnects from the locking portion 49 in interrelation with the operation to dismount. In this manner, the container 40 can be taken out of the main assembly 100 by the user. The container 40 is provided with the discrimination means for it showing that it is not the cartridge 33. The container 40 is provided with the receiving side openings 41*a* for receiving the powdery developer removed from the surface of the drum 32*a*. The container 40 is provided with the single accommodating portion 41*c* which contains the developer collected from the receiving side openings 41*a*.

The image forming unit 200 is provided with the cylindrical transfer member 34 for transferring the developer image formed on the a plurality of photosensitive drum 32*a* onto the recording material S, the a plurality of photosensitive drums 32*a*, the cartridge mounting portion 321, and the container 40. The image forming unit 200 is provided with the spring (locking portion) 49 for preventing the disengagement, from the unit 200 (main assembly 100A), of the container 40 by the elastic force by fixing the container 40 to the unit 200. In this manner, the container 40 does not disconnect from the unit 200 inadvertently. In this embodiment, the unit 200 is fixed to the main assembly 100A. However, the unit 200 may be rotated manually about a rotation axis 34*a*, for example.

There is provided a cylindrical transfer member 34 for transferring the developer images formed on the drums 32*a* onto the recording material S. The plurality of drums 32*a* are disposed along the peripheral surface of the transfer member 34, and the plurality of openings 41*a* deviate corresponding to the positions of the plurality of drums 32*a*. The feeding member 32*e* which feeds the developer removed by the cleaning member 32*c* in the axial direction of the drum 32*a* is provided with. In order to supply the developer fed by the feeding member 32*e* the container 40, there is provided openings 32*g*1 engageable with the opening 41*a*, and the size H2 of the opening 41*a* is larger than the size H1 of the corresponding opening 32*g*1. In this manner, the leakage of the developer to the opening 41*a* from the opening 32*g*1 can be prevented.

According to the present invention, a removed developer accommodating container is disposed efficiently. According to the present invention, the developer removed from a plurality of photosensitive drums can be stored in the common removed developer accommodating container. According to the present invention, a plurality of cartridges are mounted adjacent to each other and which is downsized.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 282693/2009 filed Dec. 14, 2009 which is hereby incorporated by reference.

What is claimed is:

1. An electrophotographic image forming apparatus for forming an image on a recording material, said electrophotographic image forming apparatus comprising:

an image bearing member for bearing a developer image;

a cartridge that contains a developer, said cartridge having a developing roller;

a cleaning member for removing developer remaining on a surface of said image bearing member;

a removed-developer accommodating container for accommodating the developer removed by said cleaning member, said removed-developer accommodating container being detachably mountable to a main assembly of said apparatus in a direction that intersects an axial direction of said developing roller;

a developer feeding member for feeding, in the axial direction of said developing roller, the developer removed by said cleaning member to said removed-developer accommodating container; and a case that accommodates said developer feeding member, said case having a discharging portion for discharging the developer fed by said developer feeding member to said removed-developer accommodating container, wherein said removed-developer accommodating container is adjacent to said cartridge in the axial direction of said developing roller, wherein said discharging portion is projected in the axial direction of said developing roller, and wherein said removed-developer accommodating container has (i) a recess portion that permits passage of said discharging portion and (ii) a receiving opening that opens upward for receiving the developer discharged from said discharging portion.

2. An apparatus according to claim 1, wherein said removed-developer accommodating container includes a grip portion usable for mounting and demounting relative to the main assembly.

3. An apparatus according to claim 1, further comprising a guide portion for mounting and demounting said removed-developer accommodating container relative to the main assembly, wherein said removed-developer accommodating container includes a portion-to-be-guided by said guide portion.

4. An apparatus according to claim 1, wherein said developer feeding member is provided at one end with a driving force transmitting portion for transmitting a driving force to said developer feeding member, and wherein said removed-developer accommodating container is provided at a side opposite, with respect to the axial direction of said developing roller, from a side of said developer feeding member provided with the driving force transmitting portion.

* * * * *